US011562893B2

(12) United States Patent
Silveira et al.

(10) Patent No.: US 11,562,893 B2
(45) Date of Patent: Jan. 24, 2023

(54) METHOD AND APPARATUS FOR IMPROVED ELECTROSPRAY EMITTER LIFETIME

(71) Applicant: Thermo Finnigan LLC, San Jose, CA (US)

(72) Inventors: Joshua A. Silveira, San Jose, CA (US); Michael L. Poltash, Fremont, CA (US); Wei Wei, San Jose, CA (US); Eloy R. Wouters, San Jose, CA (US)

(73) Assignee: Thermo Finnigan LLC, San Jose, CA (US)

( * ) Notice: Subject to any disclaimer, the term of this patent is extended or adjusted under 35 U.S.C. 154(b) by 33 days.

(21) Appl. No.: 17/371,702

(22) Filed: Jul. 9, 2021

(65) Prior Publication Data

US 2021/0343516 A1 Nov. 4, 2021

Related U.S. Application Data

(63) Continuation of application No. 16/690,710, filed on Nov. 21, 2019, now Pat. No. 11,087,964.

(51) Int. Cl.
*H01J 49/00* (2006.01)
*B08B 3/02* (2006.01)
(Continued)

(52) U.S. Cl.
CPC ..... *H01J 49/0031* (2013.01); *B08B 3/02* (2013.01); *B08B 5/02* (2013.01); *B08B 9/023* (2013.01);
(Continued)

(58) Field of Classification Search
CPC ..... H01J 49/0031; H01J 49/165; H01J 49/02; H01J 49/167; H01J 49/26; B08B 3/02;
(Continued)

(56) References Cited

U.S. PATENT DOCUMENTS 7,358,486 B1 4/2008 Han
9,196,468 B2 11/2015 Campbell et al.
(Continued)

FOREIGN PATENT DOCUMENTS

EP 3499546 A1 6/2019
JP 2000123781 A 4/2000
JP 2005069817 A 3/2005

OTHER PUBLICATIONS

Ab Sciex, Turbo V™ Ion Source, Operator Guide, RUO-IDV-05-6147-B (2018), 65 pages.
(Continued)

*Primary Examiner* — Kiet T Nguyen
(74) *Attorney, Agent, or Firm* — Thomas F. Cooney

(57) ABSTRACT

A method for cleaning a first electrospray emitter of a mass spectrometer comprises: changing an operating mode of the first electrospray emitter from a stable jet mode of operation to a dripping or pulsating mode of operation by lowering a magnitude of a voltage applied between a counter electrode and the first electrospray emitter, $|V_1|$; moving the first electrospray emitter from a first emitter position from which electrospray ions are delivered to a mass spectrometer inlet to a second emitter position and, simultaneously, moving a second electrospray emitter from a third emitter position to a fourth emitter position; causing a cleaning solvent to flow through the first electrospray emitter at least until a droplet of the cleaning solvent forms on an exterior surface of the first electrospray emitter while operating the electrospray emitter in the dripping mode of operation; and causing the droplet to dislodge from the emitter exterior.

11 Claims, 15 Drawing Sheets

(51) Int. Cl.

| | |
|---|---|
| ***B08B 5/02*** | (2006.01) |
| ***B08B 9/023*** | (2006.01) |
| ***H01J 49/16*** | (2006.01) |
| ***B08B 9/032*** | (2006.01) |

(52) U.S. Cl.
CPC ..... *B08B 9/0323* (2013.01); *H01J 49/165* (2013.01); *B08B 2203/02* (2013.01)

(58) Field of Classification Search
CPC ..... B08B 5/02; B08B 9/023; B08B 9/0323; B08B 2203/02
USPC ..... 250/288; 134/1.1
See application file for complete search history.

(56) References Cited

U.S. PATENT DOCUMENTS

| | | | |
|---|---|---|---|
| 9,377,445 | B2 | 6/2016 | Satake et al. |
| 9,459,240 | B2 | 10/2016 | Vorm |
| 9,947,522 | B2 | 4/2018 | Trivett et al. |
| 10,037,875 | B2 | 7/2018 | O'Brien et al. |
| 10,304,667 | B1 | 5/2019 | Reeber et al. |
| 2005/0082470 | A1 | 4/2005 | Dziekan et al. |
| 2011/0120926 | A1 | 5/2011 | Vorm et al. |
| 2013/0334416 | A1 | 12/2013 | Satake et al. |
| 2014/0047907 | A1 | 2/2014 | Murphy et al. |
| 2015/0198571 | A1 | 7/2015 | Vorm |
| 2016/0169846 | A1 | 6/2016 | Vorm et al. |
| 2017/0356575 | A1 | 12/2017 | Buerger et al. |
| 2018/0017534 | A1 | 1/2018 | Robson et al. |
| 2019/0006165 | A1* | 1/2019 | Corr ..... H01J 49/165 |
| 2019/0030493 | A1 | 1/2019 | Chowdhury et al. |

OTHER PUBLICATIONS

Kanuer PLATINblue MSQ Plus, Hardware Guide V6950A (2011), 145 pages.

Thermo Scientific, "Easy-Spray Series Ion Source", User Guide, 60053-97275 Revision C (2020), 64 pages.

Wikipedia, "Liquid chromatography-massspectrometry", Nov. 4, 2019, XP055791754, 11 pages.Retrieved from the Internet on Mar. 31, 2021:URL: https://en.wikipedia.org/w/index.php?title=Liquidchromatography-massspectrometry&oldid=924558383.

Zeleny, "The Electrical Discharge From Liquid Points, Anda Hydrostatic Method of Measuring the Electric Intensity at Their Surfaces", Physical Review (1914), vol. III (2), pp. 69-91.

* cited by examiner 166
164
161
163
Total Ion Current
0
500
1000
1500
2000
2500
Spray Voltage, |ΔV| (kV)

164
162
169
167
165
168
Spray Current
0.5
0.4
0.3
0.2
0.1
0.0
500
1000
1500
2000
2500
Spray Voltage, |ΔV| (kV)

METHOD AND APPARATUS FOR IMPROVED ELECTROSPRAY EMITTER LIFETIME

CROSS REFERENCE TO RELATED APPLICATION

This application is a continuation of U.S. application Ser. No. 16/690,710, now U.S. Pat. No. 11,087,964, which was filed on Nov. 21, 2019, the disclosure of which is hereby incorporated by reference herein in its entirety.

FIELD OF THE INVENTION

The present invention relates to mass spectrometry and mass spectrometers. More particularly, the present invention relates to spray-type ion sources for mass spectrometers.

BACKGROUND OF THE INVENTION

In electrospray ionization, a liquid is sprayed through the tip of a needle-like capillary that is held at a high electric potential of a few kilovolts. Small multiply-charged droplets containing solvent molecules and analyte molecules are initially formed and then shrink as the solvent molecules evaporate. The shrinking droplets also undergo fission-possibly multiple times-when the shrinkage causes the charge density of the droplet to increase beyond a certain threshold. This process ends when all that is left of the droplet is a charged analyte ion that can be mass analyzed by a mass spectrometer. Some of the droplets and liberated ions are directed into the vacuum chamber of the mass spectrometer through an ion inlet orifice, such as an ion transfer tube that is heated to help desolvate remaining droplets or ion/solvent clusters. A strong electric field in the tube lens following the ion transfer tube also aids in breaking up solvent clusters. The smaller the initial size of the droplets, the more efficiently they can be desolvated, and eventually, the more sensitive the mass spectrometer system becomes. Electrospray ionization is often employed to generate ions for mass spectrometric studies in which samples are provided from a liquid chromatograph or in which there is a desire or requirement to analyze intact, non-fragmented ions.

FIG. 1A is a simplified schematic diagram of a general conventional mass spectrometer system 10 comprising an electrospray ion emitter 87. The electrospray emitter 87 is configured to receive a liquid sample from an associated apparatus such as for instance a liquid chromatograph or syringe pump through a capillary tube 7. The electrospray emitter 87 emits a jet or "spray" of charged particles 84 (either ions or charged droplets that may subsequently be desolvated so as to release ions) that are representative of the sample into an ionization chamber 82. The droplets or ions are entrained in a background gas that may be provided from a gas supply line 8 that provides pressurized gas to a sheath-gas tube or nebulization-gas tube included within the electrospray ion source 87. A portion of the charged particles and background gas are intercepted by an aperture or tube 85 that transports the particles from the ionization chamber 82 to an intermediate-vacuum chamber 83 that is maintained at a lower pressure (generally less than 10 Torr) than the pressure (generally atmospheric) of the ionization chamber 82. One or more power supplies 31 provide appropriate radio-frequency (RF) and DC voltages to various electrodes of the mass spectrometer, including an electrode portion of the electrospray emitter 87.

As a result of the pressure difference between the ionization chamber 82 and the intermediate-vacuum chamber 83 (FIG. 1A), gases and entrained ions and charged droplets are caused to flow through ion aperture or tube 85 into the intermediate-vacuum chamber 83. A substantial portion of the gas is evacuated from intermediate-vacuum chamber 83 by means of a vacuum pump (not shown) coupled to vacuum port 13. Ions are caused to pass through port 86 to other mass spectrometer chambers that are maintained at still lower pressures.

FIG. 1B is an enlarged cross-sectional view of a sprayer tip region of an electrospray emitter assembly, which is disposed within a heater portion 109 of a housing (not fully shown) within which the emitter assembly is mounted. The emitter assembly is here referred to as probe 104. For reference, a portion of the heater 109, which is a component of the housing, is also depicted in FIG. 1B. The purpose of the heater is to heat an auxiliary gas that flows in one or more channels 122 between the heater and the probe 104. After emerging from the channels, the heated auxiliary gas mixes with a spray plume that emerges from the end of the needle capillary 113. The heat provided by the heated auxiliary gas assists in evaporation of the solvent portion of the droplets so as to thereby liberate charged ions.

In operation, the probe tip projects into the interior of the ionization chamber 82 with the remaining length of the probe 104 being disposed within the housing. A spray of charged droplets of a liquid sample is introduced into the spray chamber interior 82 from the end of needle capillary 113. In this process, a continuous stream of liquid sample is provided through the lumen of the needle capillary 113. The spray plume of charged droplets is formed at the end of the needle capillary 113 under the action of an electrical potential difference between the needle capillary and a counter electrode (not shown), as assisted by a flow of the nebulizing gas (also known as sheath gas). In operation, the nebulizing gas flows along the length of probe in the direction of the tip through a channel 118 of a heat-insulating enclosure 117, such as a tube, that encloses a portion of the length of the needle capillary 113. The flow of nebulizing gas is directed, as shown by the arrows in channel 118, from the heat-insulating enclosure 117 into a channel 120 of needle support structure 115 that encloses another portion of the length of the needle capillary 113. The heat-insulating enclosure 117 may be constructed of a heat-insulating material, such as a ceramic, that shields the transfer of heat from the heater 109 to the needle capillary 113.

Nano electrospray ionization (so-called "nanospray") is a form of electrospray ionization that employs small-bore tips on the order of tens of micrometers in diameter. This small size limits the maximum solvent flow rates to the range of tens of microliters to nanoliters per minute. It is well known in the art that, of all the variants of electrospray ionization, nanospray ionization yields the highest current per analyte concentration. This result is attributed to the small bore of the electrospray emitter needles employed, which cause the diameter of the droplets formed at the Taylor cone to be the smallest, such that the combined effects of smaller initial droplet size and higher analyte concentration (as a result of less required solvent) promote a greater degree of solvent evaporation and analyte desolvation than is achieved by regular electrospray devices (e.g., FIG. 1B). Generally, auxiliary gas and nebulizing gas flows are not required with a nanospray ionization system. Therefore, nanospray ionization systems offer the twin advantages of being able to provide sensitive results while, at the same time, being smaller and less complex than regular electrospray systems.

U.S. Pat. No. 9,459,240, in the name of inventor Vorm, teaches an integrated system for liquid separation electrospray ionization comprising: a chromatographic separation column; and an electrospray emitter connected with the separation column. According to the teachings of U.S. Pat. No. 9,459,240, the separation column, a heating and/or cooling unit for controlling the temperature of the column and a nano-electrospray emitter (commonly referred to as a "needle") are provided as an integral unit. Specifically, the various components are embedded within a plastic housing that is provided as a removeable and replaceable cartridge. Such replaceable cartridges are commercially available from Thermo Fisher Scientific of Waltham, Mass. USA under the EASY-Spray™ trade name. The cartridge format exploits the relative simplicity and small-size advantages of nanospray while also providing a rugged format that protects the fragile nanospray components. U.S. Pre-Grant Publ. No. 2018/0017534 teaches a modification of the apparatus taught by the Vorm patent, in which the emitter assembly is provided as a stand-alone unit, separate from any separation column.

FIG. 2A is a schematic example of a portion of a mass spectrometer system that employs a replaceable cartridge 61, as taught in the Vorm patent. The cartridge 61 comprises a ring-shaped portion 67, within which a substantial portion of a coiled nano-liquid-chromatography column is disposed, and a tubular probe portion 68, within which a portion of a nanospray emitter needle is housed. The inlet end of the column is provided with a coupler fitting 63 that is used, for example, to receive a sample-bearing liquid and/or mobile phases provided by fluid tubing line 7. A mounting assembly 64, which is preferably removable from a mass spectrometer housing, may be used to attach and detach the cartridge from a mass spectrometer. The emission tip of the nanospray emitter (not shown in FIG. 2B), together with its protective sleeve 240, protrudes into an ionization chamber 82. The ionization chamber 82 is bounded by a wall 81 of the mass spectrometer housing and the mounting assembly 64, the latter of which includes a window 66 that permits viewing of the emission tip of the emitter.

A power supply 31 provides a voltage, V, between a counter-electrode and the emitter. That is, $V=E_c-E_e$, where $E_c$ and $E_e$ are electrical potentials at the counter electrode and the emitter, respectively and where one of these electrical potentials may be ground potential. If positively-charged ions are being generated, then $V<0$; if negatively-charged ions are being generated, then $V>0$. To cover both such possibilities, this document generally refers to refers to the absolute magnitude of the voltage, $|V|$ with the understanding that $V<0$ if positive ions are being generated and mass analyzed and $V>0$ if negative ions are begin generated and mass analyzed. Generally, the counter electrode is at (or is) an ion inlet of a mass spectrometer. At the emitter or elsewhere within a fluid-transporting conduit, an electrical lead is in contact with an internal sample-bearing liquid, through internal electrical connections as described further below. Note that, in this document, the terms "magnitude" and "absolute magnitude" are used interchangeably.

The mounting assembly includes a moveable translation stage 65 on which the cartridge 61 is disposed and that may be used to position the emitter tip in alignment with an ion inlet 85 of the mass spectrometer. During the positioning, the protective sleeve 240 partially retracts upon engagement with a seating surface of the ion inlet 85 to expose the tip of the emitter. The alignment may be performed either automatically or manually. Charged particles emitted by the nanospray needle are directed into an intermediate-vacuum chamber 83 of the mass spectrometer. Other downstream components of the mass spectrometer are not shown in FIG. 2A.

FIG. 2B is a schematic diagram of cross-sectional side view of the emitter assembly within a cartridge as described in U.S. Pat. No. 9,459,240 and further including a union 220 having an internally threaded side 222 for coupling to a column, as described U.S. Pre-Grant Publ. No. 2018/0017534. The embodiment shown in FIG. 2B includes an electrospray emitter 230 held in place with PEEK sleeve 235, cap nut 270 and ferrule 280. The emitter is typically a fused silica, metal, glass, or ceramic needle or capillary as known in the LCMS community. A fused silica emitter may be metallized. If the cartridge does not include an embedded column, then the threaded union 220 may be employed for attachment and detachment of a separate column having a male end fitting.

At or near the inlet of the emitter 230, a stop 201 is integrated into the union 220 with a defined through hole to ensure a proper electrical connection to the liquid entering the emitter. The other side of the union 220 is a fitting for receiving a number of standard capillary connections. The union 220 includes an externally threaded side 233 and a threaded inlet side 222. Alternatively, the electrical connection may be made elsewhere within or on a conduit that transports liquid sample to the emitter, such as at the outside of a metal or metallized fused silica emitter. As another example, the voltage may be applied through an electrical connection at or adjacent to the chromatography column, such as at the entrance to the column. This type of electrical connection is applicable in the case of so-called "packed-tip emitters", in which the emitter and the chromatographic column are a single entity.

A protective sleeve 240 of generally cylindrical form is slidably located on the emitter 230. The sleeve 240 has a main body 210 and a base 211 of a wider diameter than the main body. The protective sleeve 240 is generally made of plastic. A PEEK sleeve 235 covers at least a central portion of the emitter 230 and is adapted to closely fit between an outer diameter of the emitter 230 and the protective sleeve 240. Mounted around the protective sleeve 240, in one embodiment, is an electrically conductive sheath 250. The conductive sheath is supported at one end by the cap nut 270. The sheath may be detached from the column fittings at that end. The conductive sheath 250 has an internal diameter such as to accommodate therein the protective sleeve 240 and permit the protective sleeve 240 to slidably move in a reciprocating manner inside the sheath, described in further detail below.

A resilient member or spring 260 is provided inside the electrically conductive sheath 250, positioned in a space between the emitter fittings and the protective sleeve 240, thereby to act upon the base of the protective sleeve. In this way, the spring 260 biases the sleeve 240 to force it out of the conductive sheath 250. The length of the sleeve 240 and its extension out of the sheath is sufficient to cover the tip of the emitter 230 and act to protect it against damage. A part of the main body 210 of the protective sleeve 240 protrudes outside the sheath 250 and thereby covers the emitter. The extent of travel of the sleeve 240 out of the sheath 250 is restricted by a reduced internal diameter part 290 at the end of the sheath 250 that stops the wider diameter base 211 of the sleeve. If a force is applied to the sleeve to push the sleeve backwards into the sheath 250 the spring 260 becomes compressed and the tip of the emitter becomes exposed and ready for use. The electrically conductive sheath 250 has a recess in the form of a circumferential groove 249 in its outer surface for the purpose of making contact with an electrode, e.g. a contact ball.

The column and the emitter, or cartridge containing both components, is a consumable with limited lifetime. Ideally, hundreds of samples can be processed but the lifetime is principally dependent on the type of samples analyzed. It has been found that, during electrospray ionization, material from the sample routinely deposits on the external surface of the emitter—presumably, resulting from evaporation of solutes after the eluent has wicked-back onto the external emitter surface. This fouling of the emitter may be particularly problematic when using nanospray emitters. For example, FIG. 3 is a to-scale schematic depiction of a clean nanospray emitter as employed in a replaceable cartridge 61 (FIGS. 2A-2B). The nanospray emitter shown in FIG. 3 comprises a fused silica capillary 142 having an outer diameter of 150 microns over most of its length and an internal bore 143 that is 10 microns in diameter. At the emission tip of the emitter, the outer surface of the capillary comprises a tapered nozzle 144 that terminates in an outlet end at which the capillary diameter is approximately 30 microns. FIGS. 4A and 4B are schematic depictions of a used and fouled nanospray capillary, as reproduced from photomicrographs obtained under 200× magnification.

The fouled emitter was removed from service after having been used to ionize approximately 1,000 replicate HeLa cell lysate injections for mass analysis. FIG. 4A is a reproduction of a first photomicrograph taken immediately after the emitter capillary was removed from service; FIG. 4B is a reproduction of a second photomicrograph that was taken after the capillary was washed with acidified water. It was found, in this instance, that the fouled capillary comprised deposits of two different materials. A first polycrystalline white material 147*a* was removed by the washing. However, a second contaminant material 147*b* that was present in the form of a thin brown film was not removed by the washing. Removal of the second contaminant material (which was not attempted) would require a second washing using a more aggressive solvent.

Material deposited on an electrospray emitter can ultimately cause degradation of several analytical figures-of-merit (e.g., reduced sensitivity and/or reproducibility). For example, FIG. 5 is a plot of the measured peak area of the peptide GILFVGSGVSGGEEGAR for a series of sample injections into the depicted fouled emitter at each of three periods of the service lifetime of that emitter. The leftmost portion of FIG. 5 depicts the measured peak area during 77 injections at the beginning of the service lifetime. Likewise, the center and rightmost portions of the FIG. 5 depicts the measured peak area during 139 injections near the middle and 84 injections near the end of the service lifetime, respectively. In addition, the percentage Relative Standard Deviation (RSD) values for each period of the emitter's lifetime are listed above the corresponding plot. The data of FIG. 5 indicates a progressive loss of mass spectrometer signal and a corresponding significant loss of signal reproducibility with time, both of which are attributed to the fouling of the emitter capillary. With regard to the column that was in service at the same time as the emitter of FIGS. 4A-4B, it is noteworthy that subsequent analysis determined that the column performance remained near constant over the course of the approximately 1,000 injections. Instead, it was the residue buildup on the emitter that caused the end of life of the cartridge (containing both the column and the emitter) by increasing the peak area relative standard deviation to a point where the analytical measurements were no longer reproducible.

SUMMARY

From the above observations of progressive emitter fouling and a corresponding loss of mass spectral quality, the inventors have realized that, instead of implementing a single emitter wash step at the end of a long series of sample injections, a more favorable washing sequence would be to perform several regular emitter washing steps during an experimental sequence. Accordingly, this disclosure teaches methods and apparatuses for performing regular emitter washings that do not require removal of the emitter (or a cartridge containing the emitter from) a mass spectrometer. Methods and apparatus in accordance with the present teachings instead make use of the non-emitting electrospray modes (specifically, dripping and pulsating) for implementing emitter washing steps.

In accordance with a first aspect of the present teachings, a method for cleaning an electrospray emitter of a mass spectrometer is provided, the method comprising: (a) changing a mode of operation of the electrospray emitter from a stable jet mode of operation to a dripping mode or pulsating mode of operation by lowering a magnitude of a voltage, $|V|$, applied between a counter electrode and the electrospray emitter; (b) causing a cleaning solvent to flow through the electrospray emitter at least until a droplet of the cleaning solvent forms on an exterior surface of the electrospray emitter while operating the electrospray emitter in the dripping mode or pulsating mode of operation; and (c) causing the droplet to dislodge from the electrospray emitter exterior. Generally, the value of $|V|$ below which the mode of operation of any electrospray emitter changes from a stable jet mode of operation to a pulsating mode of operation (indicated at 168 in FIG. 6B) or below which the mode changes from a pulsating mode to a dripping mode (indicated at 165 in FIG. 6B) may be determined by a prior mapping of the electrospray modes of the emitter in terms of applied $|V|$.

In some instances, or in some apparatus embodiments, it may be necessary to include an additional step of moving the emitter away from its normal operating position prior to the step (a) of changing the mode of operation the emitter or at least prior to the step (b) of causing the cleaning solvent to flow through the emitter. Such movement of the emitter away from a mass spectrometer inlet during portions of the cleaning procedure prevents the ingestion of neutral gas molecules, liquid droplets or contaminant substances into the mass spectrometer inlet. In such instances, the electrospray emitter must be returned to its normal operating position prior to returning to normal operation. The movements away from and back to the normal operating position may controlled by a motorized moveable stage or platform onto which the emitter is mounted.

The dislodging of the droplet of cleaning solvent from the emitter exterior removes any formerly-contaminating substances that were dissolved by the droplet while it was in contact with the exterior surface of the emitter. The dislodging may occur under the action of gravity. Alternatively, the dislodging of the droplet may be caused or assisted by directing a pulse of gas towards the droplet. The pulse of gas may be supplied by a nebulizing gas orifice of the electrospray emitter. Alternatively, if the electrospray emitter does not comprise a nebulizing gas orifice, the gas pulse may be provided by an auxiliary gas line provided for the purpose of supplying the gas pulse. As a yet further alternative, the droplet may be dislodged by providing a voltage pulse to either the electrospray emitter or a counter electrode at or near an ion inlet of the mass spectrometer.

According to some embodiments, the electrospray emitter that is being cleaned may be fluidically coupled to a liquid chromatographic column. In some instances, the cleaning solvent may comprise a same mobile phase liquid that is used to transport dissolved samples to the emitter under normal operating conditions. In such instances the cleaning solvent may be provided to the emitter directly through the chromatographic column. In some other instances, the cleaning solvent may comprise a cleaning compound that would be detrimental to the column were it to be passed through the column. In such latter instances, provision may be made to supply the cleaning solvent and the cleaning solvent may be supplied at a point in a fluid supply line that is downstream from the column but upstream from the emitter. If the emitter and column are housed together within a removable cartridge, the cleaning solvent may be introduced into an auxiliary fluid inlet port of the cartridge that is configured such that the cleaning solvent does not pass through the column.

Certain embodiments of the method may include the further steps of: (d) causing a second cleaning solvent, comprising a composition different than a composition of the first cleaning solvent, to flow through the electrospray emitter at least until another droplet forms on the exterior surface of the electrospray emitter while operating the electrospray emitter in the dripping mode of operation; and (e) causing the other droplet to dislodge from the electrospray emitter exterior. According to some embodiments, either the steps (b) and (c) or the steps (d) and (e) may need to be repeated one or more times until a targeted contamination substance is adequately removed from the emitter. The repetitions may continue until an operator, visually observing the cleaning process, determines that the electrospray emitter is sufficiently clean to be put back into service. Alternatively, the repetitions may continue for a duration of time corresponding to a pre-determined cleaning time period.

The initiation of the steps (listed herein) of the various embodiments of electrospray emitter cleaning methods that are in accordance the first aspect of the present teachings may be performed automatically, at regular time intervals, during the service lifetime of an electrospray emitter. Alternatively, the initiation of the steps listed herein may occur, automatically, each time a new mass analysis or a new set of mass analyses is performed, such as at the start of the new mass analysis or new set of mass analyses.

In accordance with a second aspect of the present teachings, a method for cleaning a first electrospray emitter of a mass spectrometer is provided, the method comprising: (a) changing a mode of operation of the first electrospray emitter from a stable jet mode of operation to a dripping mode or a pulsating mode of operation by lowering a magnitude of a voltage, |V|, applied between a counter electrode and the electrospray emitter; (b) moving the first electrospray emitter from a first position from which electrospray particles are delivered to an inlet of a mass spectrometer to a second position; (c) moving a second electrospray emitter to the first position; (d) causing a cleaning solvent to flow through the first electrospray emitter at least until a droplet of the cleaning solvent forms on an exterior surface of the first electrospray emitter while operating the first electrospray emitter in the dripping mode of operation; and (e) causing the droplet to dislodge from the first electrospray emitter exterior.

Generally, the magnitude of the lowering of |V| that is required to change the mode of operation of the first electrospray emitter from a stable jet mode of operation to a dripping mode or pulsating mode of operation may be determined by a prior mapping of the electrospray modes of that emitter in terms of applied |V|. The dislodging of the droplet of cleaning solvent from the first electrospray emitter exterior removes any formerly-contaminating substances that were dissolved by the droplet while it was in contact with the exterior surface of the emitter. The dislodging may occur under the action of gravity. Alternatively, the dislodging of the droplet may be caused or assisted by directing a pulse of gas towards the droplet. The pulse of gas may be supplied by a nebulizing gas orifice of the first electrospray emitter. Alternatively, if the first electrospray emitter does not comprise a nebulizing gas orifice, the gas pulse may be provided by an auxiliary gas line provided for the purpose of supplying the gas pulse. As a yet further alternative, the droplet may be dislodged by providing a voltage pulse to either the first electrospray emitter or a counter electrode at or near an ion inlet of the mass spectrometer. Such a voltage pulse may cause a temporary discharge of liquid from an internal channel of the first electrospray emitter that physically dislodges the droplet of cleaning solvent.

According to some embodiments, the electrospray emitter that is being cleaned (e.g., the first electrospray emitter) may be fluidically coupled to a liquid chromatographic column. In some instances, the cleaning solvent may comprise a same mobile phase liquid that is used to transport dissolved samples to the emitter under normal operating conditions. In such instances the cleaning solvent may be provided to the first electrospray emitter directly through the chromatographic column. In some other instances, the cleaning solvent may comprise a cleaning compound that would be detrimental to the column were it to be passed through the column. In such latter instances, provision may be made to supply the cleaning solvent and the cleaning solvent may be supplied at a point in a fluid supply line that is downstream from the column but upstream from the first electrospray emitter. If the first electrospray emitter and column are housed together within a removable cartridge, the cleaning solvent may be introduced into an auxiliary fluid inlet port of the cartridge that is configured such that the cleaning solvent does not pass through the column.

Certain embodiments of the method may include the further steps of: (f) causing a second cleaning solvent, comprising a composition different than a composition of the first cleaning solvent, to flow through the first electrospray emitter at least until another droplet forms on the exterior surface of the first electrospray emitter while operating that emitter in the dripping mode of operation; and (g) causing the other droplet to dislodge from the exterior of the first electrospray emitter. According to some embodiments, either the steps (d) and (e) or the steps (f) and (g) may need to be repeated one or more times until a targeted contamination substance is adequately removed from the first electrospray emitter. The repetitions may continue until an operator, visually observing the cleaning process, determines that the first electrospray emitter is sufficiently clean to be put back into service. Alternatively, the repetitions may continue for a duration of time corresponding to a pre-determined cleaning time period.

According to some embodiments, the first and second electrospray emitters may be housed in separate cartridges, where each cartridge comprises: the respective electrospray emitter; and a respective chromatographic column. Both such cartridges may be mounted onto a motorized moveable stage or platform the moves both cartridges simultaneously in accordance with the steps of the method. Alternatively, both the first and second electrospray emitters may be housed in a same cartridge. That single cartridge may be disposed upon a motorized moveable stage or platform that moves the single cartridge, thereby moving both electrospray emitters simultaneously in accordance with the steps of the method. The use of two separate electrospray emitters beneficially provides improved analysis efficiency in that, in the absence of the second electrospray emitter, instrument analysis time would be lost while the first emitter is being cleaned. The step (b) of moving of the first electrospray emitter from the first position to the second position may comprise: (i) moving the first electrospray emitter away from the inlet parallel to a longitudinal axis of the emitter or of the inlet; and (ii) moving the first electrospray emitter in a direction orthogonal to the aforementioned longitudinal axis. The step (c) of moving the second electrospray emitter to the first position may comprise: (iii) moving the second electrospray emitter in a direction orthogonal to a longitudinal axis of the emitter or of the inlet; and (iv) moving the first electrospray emitter towards the inlet in a direction parallel to the longitudinal axis.

In accordance with a third aspect of the present teachings, a sample introduction system for a mass spectrometer is provided, the system comprising: (i) a source of sample; (ii) a chromatographic column comprising a column inlet that is fluidically coupled to the source of sample and a column outlet; (iii) and electrospray emitter comprising an emitter inlet that is fluidically coupled to the column outlet; (iv) a source of cleaning solvent that is fluidically coupled to the emitter inlet; (v) a voltage supply electrically coupled to the electrospray emitter and to a counter electrode; and (vi) a computer or electronic controller comprising computer-readable instructions that are operable to: (a) cause the voltage supply to lower a magnitude of a voltage, |V|, applied between the counter electrode and the electrospray emitter, wherein the lowering of |V| causes a change of a mode of operation of the electrospray emitter from a stable jet mode of operation to a dripping mode or a pulsating mode of operation; (b) cause at least a portion of the cleaning solvent to flow from the source of cleaning solvent to and through the electrospray emitter at least until a droplet of the cleaning solvent forms on an exterior surface of the electrospray emitter while operating the electrospray emitter in the dripping mode of operation; and (c) cause the droplet to dislodge from the electrospray emitter exterior.

According to some embodiments, the sample introduction system may further comprise a source of gas, wherein the computer-readable instructions that are operable to cause the droplet to dislodge from the electrospray emitter exterior are operable to cause the dislodgement by causing the source of gas to apply a pulse of gas to the droplet. According to some embodiments, the sample introduction system may comprise a coupling union fluidically coupled between the chromatographic column outlet and the electrospray emitter inlet, the coupling union further fluidically coupled to the source of cleaning solvent. According to some embodiments, the chromatographic column and the electrospray emitter may be housed within a same cartridge. In accordance with some embodiments, the computer-readable instructions are further operable to automatically execute the steps (a) through (c) upon the occurrence of a pre-determined number of injections of a sample or samples into the electrospray emitter subsequent to a prior cleaning of the electrospray emitter.

According to some embodiments, the computer-readable instructions are further operable to: (d) cause a cessation of the flow of cleaning solvent to and through the electrospray emitter; (e) cause a flow of liquid sample to flow from the source of sample to the column inlet; and (f) increase the magnitude of the voltage, |V|, applied between the counter electrode and the electrospray emitter by the voltage supply, wherein the increase of |V| causes a change of a mode of operation of the electrospray emitter from the dripping mode of operation to the stable jet mode of operation.

BRIEF DESCRIPTION OF THE DRAWINGS

The above noted and various other aspects of the present invention will become apparent from the following description which is given by way of example only and with reference to the accompanying drawings, not necessarily drawn to scale, in which.

DETAILED DESCRIPTION

Figure 1A:
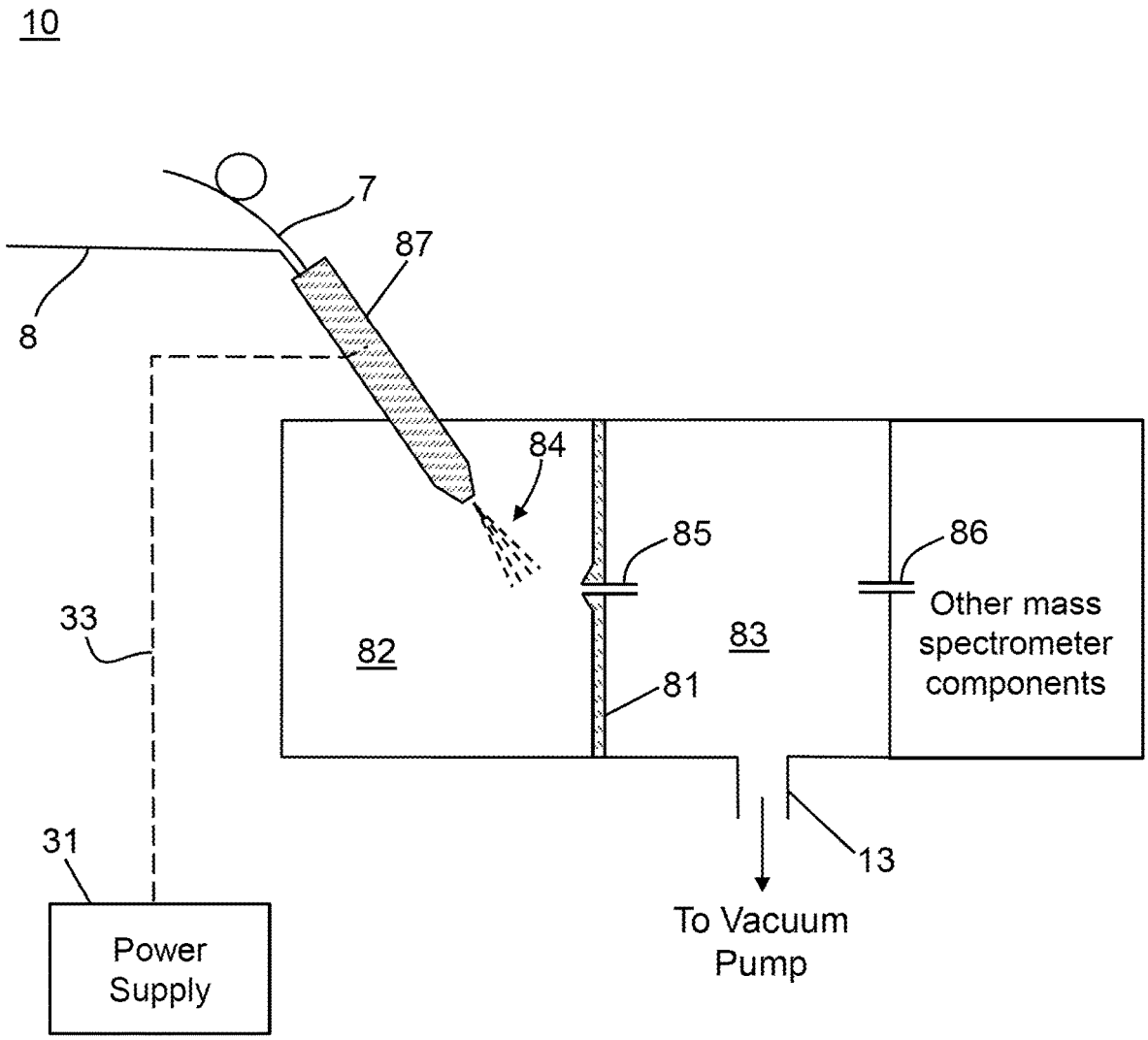
FIG. 1A (Prior Art)
FIG. 1A is a schematic depiction of a general electrospray ion source for a mass spectrometer.
Figure 1B:
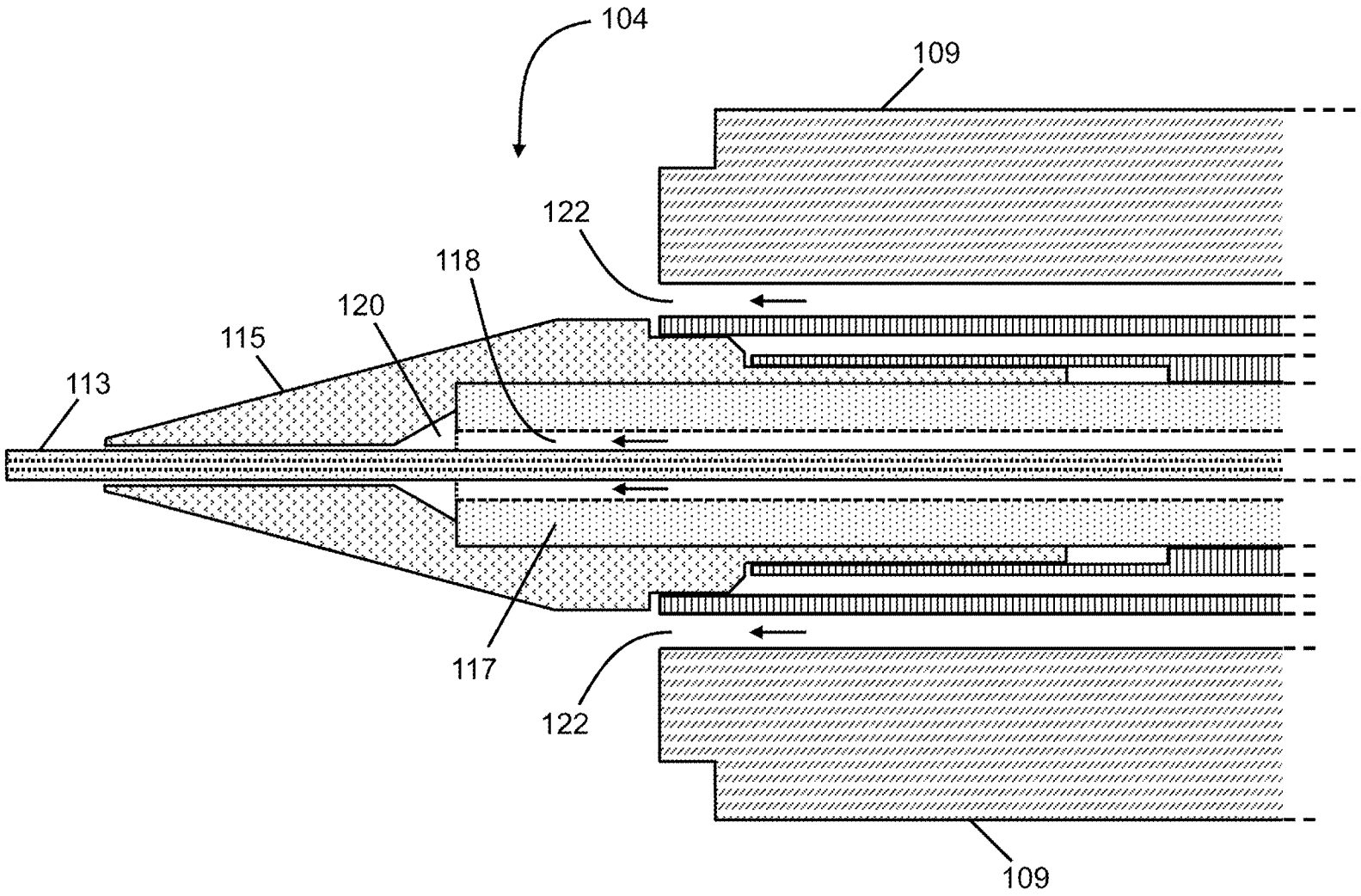
FIG. 1B (Prior Art)
FIG. 1B is a is a schematic depiction of an electrospray probe assembly as may be employed within the electrospray ion source of FIG. 1A.
Figure 2A:
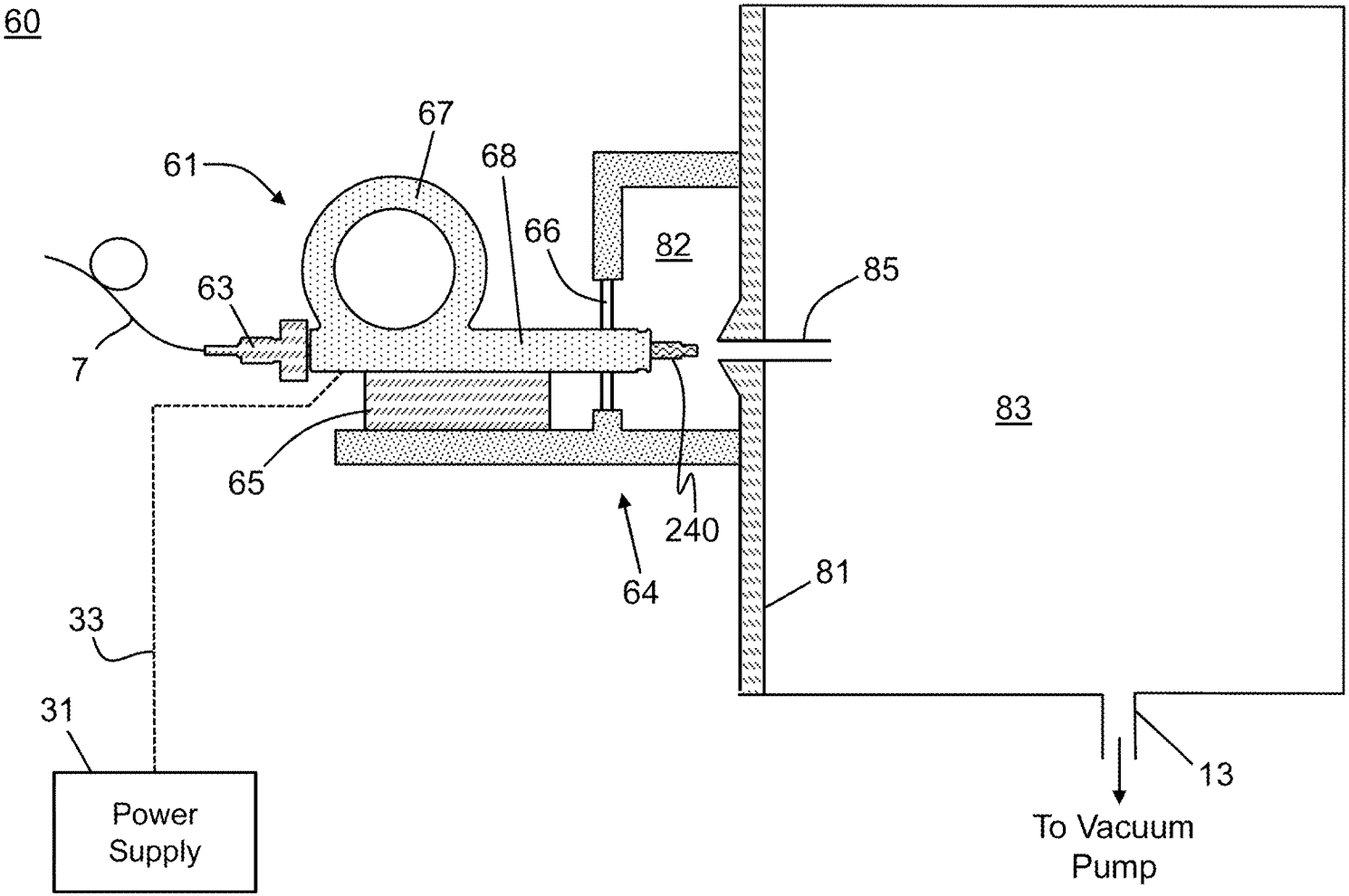
FIG. 2A (Prior Art)
FIG. 2A is a schematic depiction of a known nano-electrospray ion source for a mass spectrometer in which an electrospray emitter is provided within a removable cartridge.
Figure 2B:
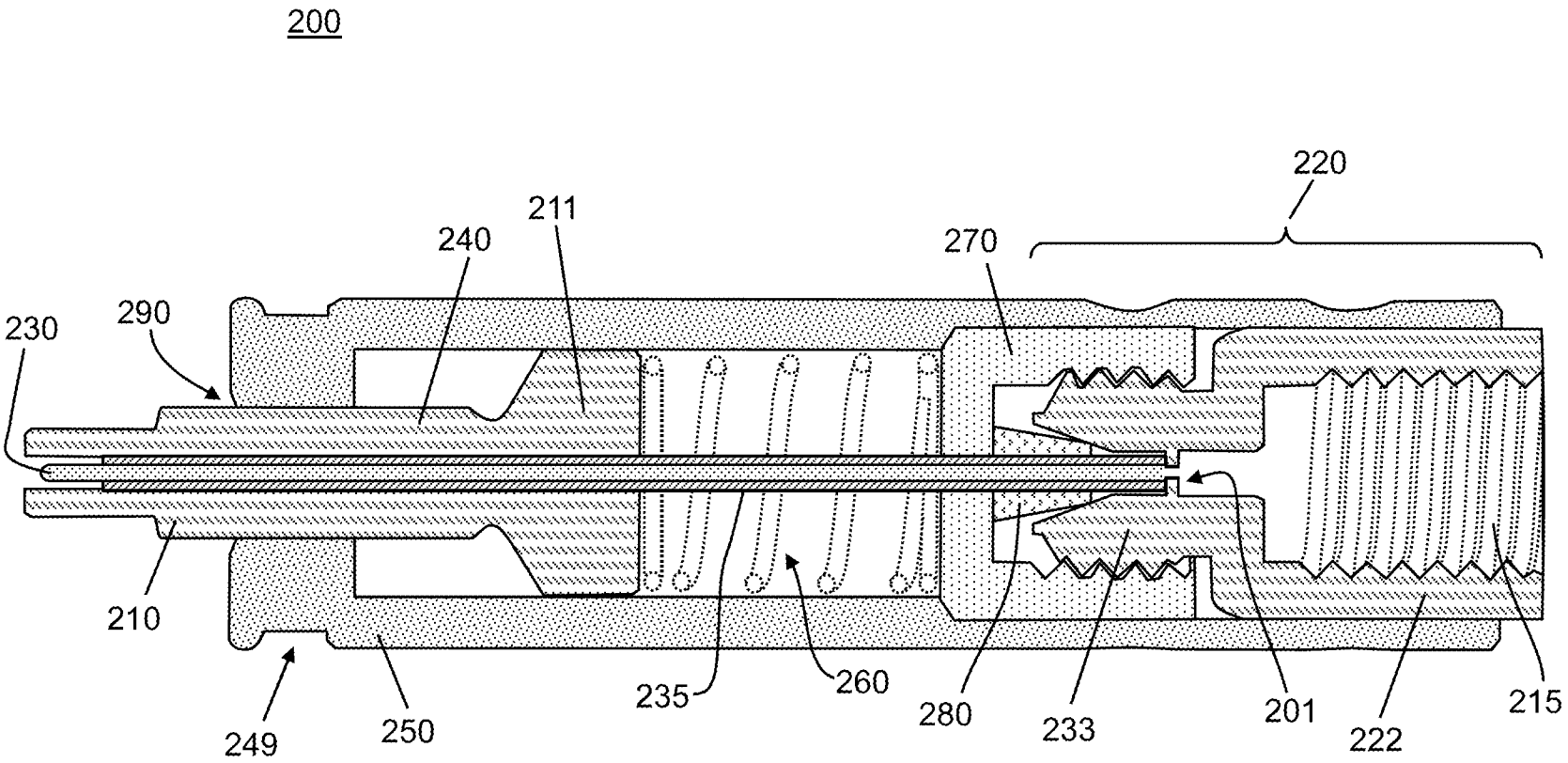
FIG. 2B (Prior Art)
FIG. 2B is a schematic cross-sectional depiction of the internal components of a known removable cartridge that houses a nano-electrospray emitter.
Figure 3:
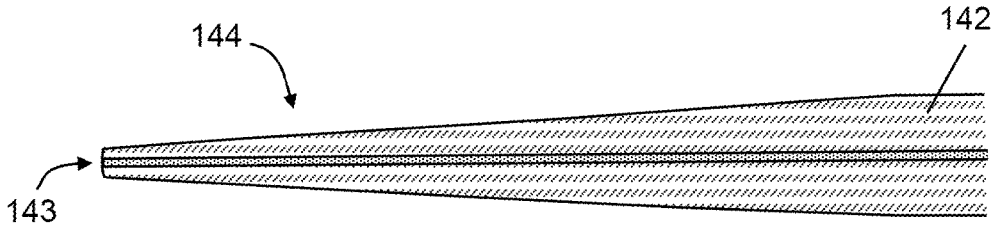
FIG. 3 is a to-scale depiction of an emission tip of a known nano-electrospray emitter.

The following description is presented to enable any person skilled in the art to make and use the invention, and is provided in the context of a particular application and its requirements. Various modifications to the described embodiments will be readily apparent to those skilled in the art and the generic principles herein may be applied to other embodiments. Thus, the present invention is not intended to be limited to the embodiments and examples shown but is to be accorded the widest possible scope in accordance with the features and principles shown and described. To fully appreciate the features of the present invention in greater detail, please refer to FIGS. 1A-10 in conjunction with the following description.

In the description of the invention herein, it is understood that a word appearing in the singular encompasses its plural counterpart, and a word appearing in the plural encompasses its singular counterpart, unless implicitly or explicitly understood or stated otherwise. Furthermore, it is understood that, for any given component or embodiment described herein, any of the possible candidates or alternatives listed for that component may generally be used individually or in combination with one another, unless implicitly or explicitly understood or stated otherwise. Moreover, it is to be appreciated that the figures, as shown herein, are not necessarily drawn to scale, wherein some of the elements may be drawn merely for clarity of the invention. Also, reference numerals may be repeated among the various figures to show corresponding or analogous elements. Additionally, it will be understood that any list of such candidates or alternatives is merely illustrative, not limiting, unless implicitly or explicitly understood or stated otherwise.

Figure 6A:
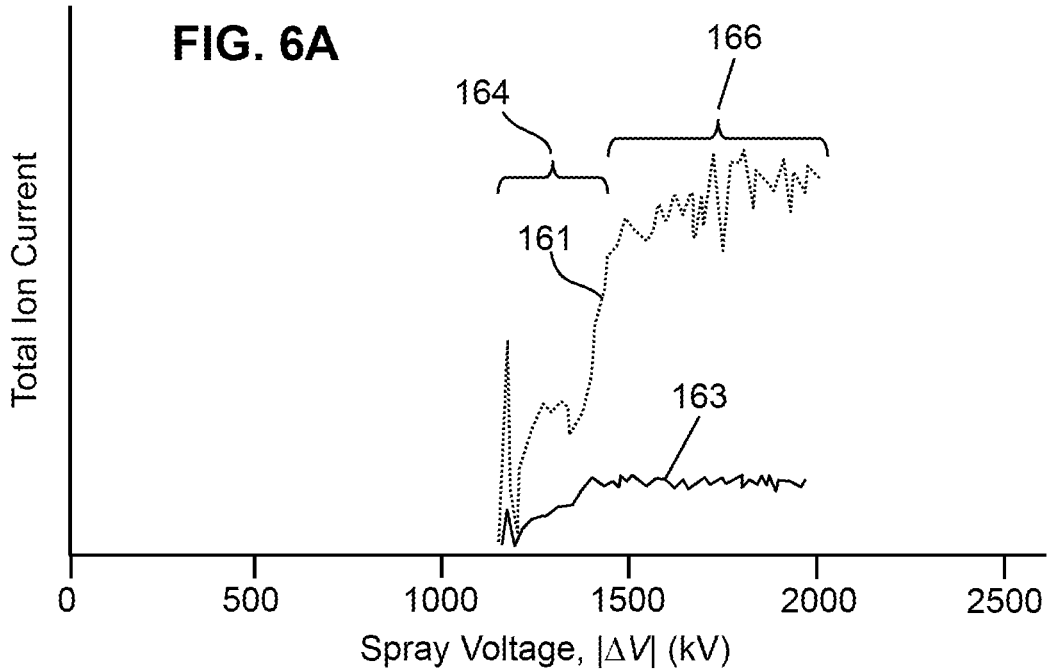
FIG. 6A is set of plots of total ion current of two different ions versus applied emitter voltage, |V|, as generated by a mass spectrometer interfaced to an electrospray emitter having a 10 micron internal diameter through which was passed a solution containing 2% acetonitrile in water with 0.1% formic acid.
Figure 6B:
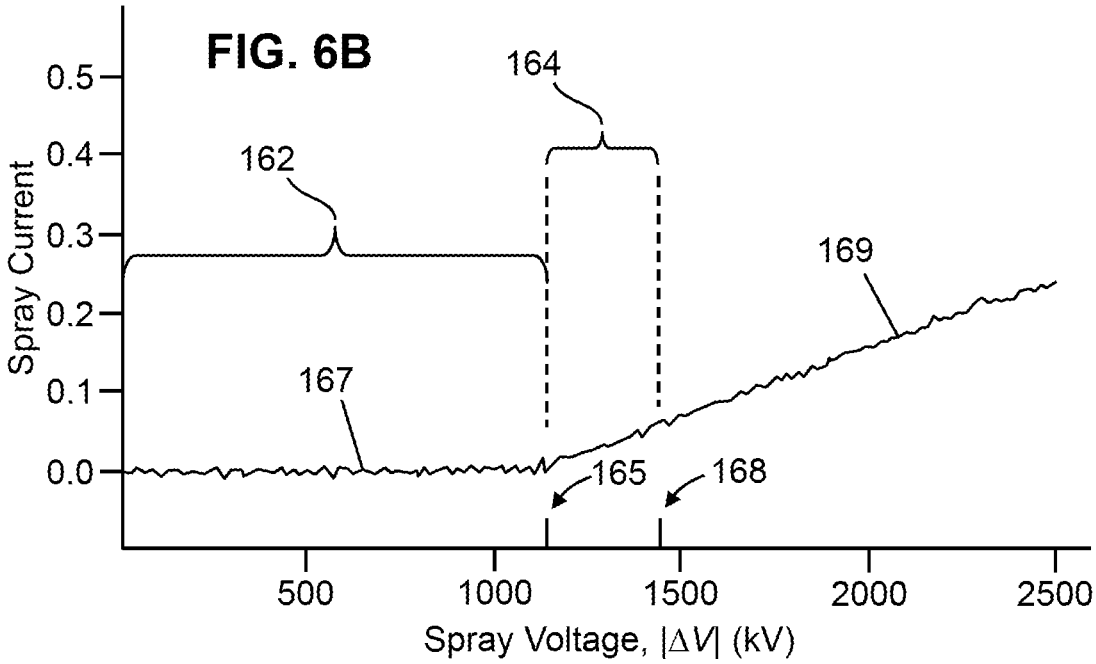
FIG. 6B is a plot of spray current as generated by a mass spectrometer under the experimental conditions described in the caption to FIG. 6A.

In this document, the term "online emitter cleaning" is used to refer to cleaning of an electrospray emitter without removal of the emitter from a mass spectrometer. The present inventors have realized that online emitter cleaning may be facilitated by making use of certain electrospray spray modes that are not generally employed during normal mass spectrometric operation. Early work by Zeleny (Zeleny, John. "The electrical discharge from liquid points, and a hydrostatic method of measuring the electric intensity at their surfaces." Physical Review 3, no. 2 (1914): 69.) indicated that electrospray ionization could be operated in various modes including dripping, pulsating, and a stable jet mode. For example, FIG. 6A includes plots 163, 166 of the total ion current associated with each of two selected ions during a ramp of |V|. FIG. 6B is the measured spray current during the ramping of |V|. Taken together, features of the FIG. 6A and FIG. 6B illustrate the applied voltage regions corresponding to the dripping, pulsating and stable jet emission regimes. The data for these plots was generated from a mass spectrometer interfaced to an electrospray emitter having a 10 micron internal diameter through which was passed a solution containing 2% acetonitrile in water with 0.1% formic acid.

In the dripping mode 162, which corresponds to plot graph segment 167 (FIG. 6B), droplets of liquid accumulate on the emitter surface until the surface tension can be overcome by both gravitational and electric forces. Spherical liquid droplets are regularly formed at a low frequency since the electrical forces are relatively weak. At increased values of |V| above a first critical voltage shown at 165, the pulsating mode 164 (FIGS. 6A-6B) is encountered at the slope break between graph segment 167 and graph segment 169. This mode is characterized by more erratic droplet ejection at higher frequencies. By further increasing the value of |V| above a second critical voltage shown at 168, a stable jet mode 166 (FIG. 6A) is achieved wherein charged droplets are generated from an electrified liquid cone, commonly referred to as a "Taylor cone". By increasing |V| further, formation of multiple jets is possible, through operation with a single cone jet has proven to be the most stable and widely used regime for analytical measurements.

The present inventors have realized that online emitter cleaning may be readily achieved by temporarily switching emitter operation to the dripping mode or, less desirably, the pulsating mode of operation while causing a cleaning solvent to flow through the emitter. Such operation permits droplets of an appropriate liquid cleaning solvent to accumulate on the emitter surface. Accumulated unwanted solid residue that comes into contact with the solvent on the emitter surface will be dissolved into the droplet. Subsequent removal or expulsion of the droplet from the emitter surface then removes the dissolved residues from the emitter.

Figure 7A:
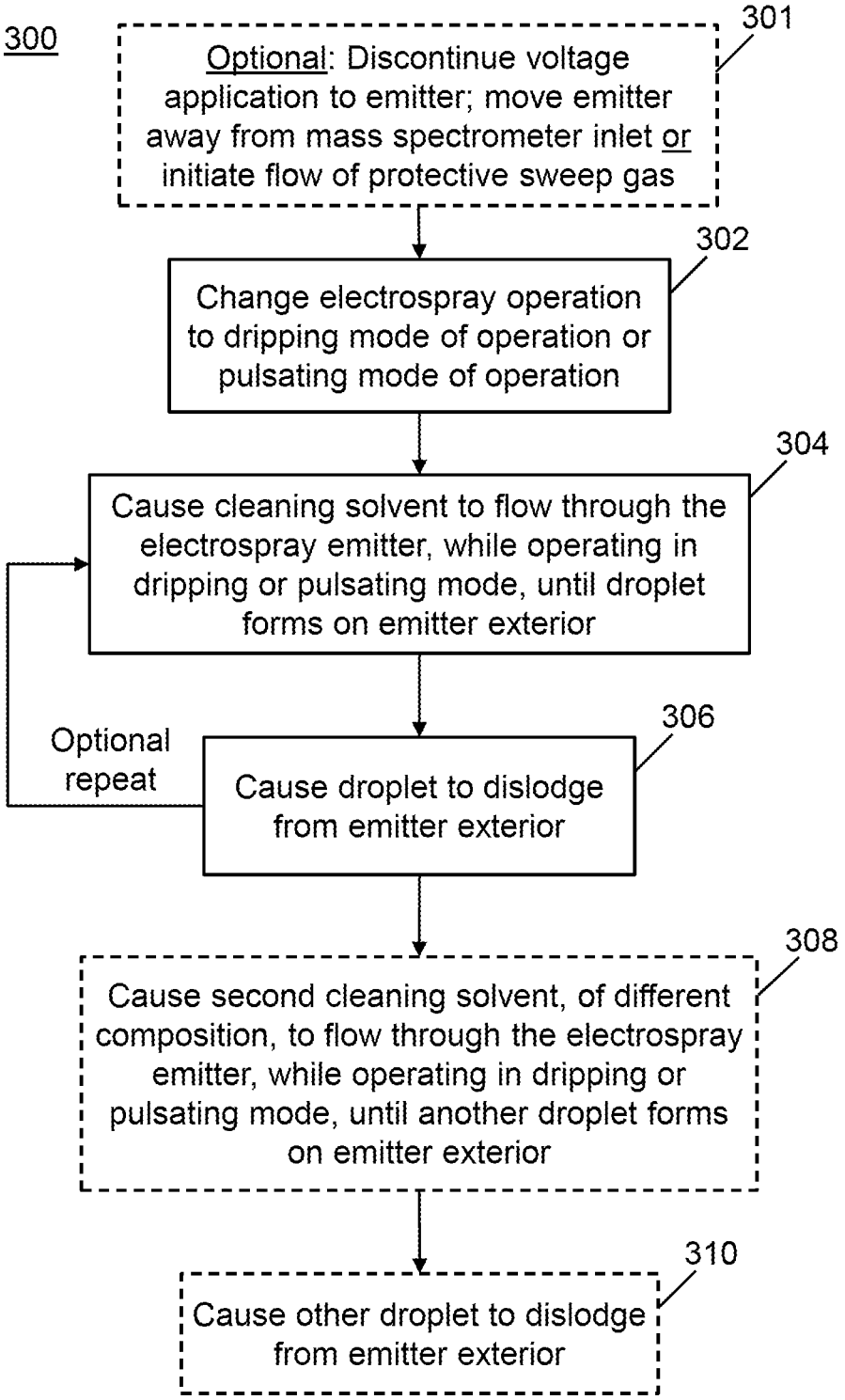
FIG. 7A is a flow diagram of a first method for cleaning an electrospray emitter in accordance with the present teachings.

FIG. 7A is a flow diagram of an emitter cleaning method as described above. In step 302 of the method 300 (FIG. 7A), the emitter is removed from service by changing its mode of operation to a dripping mode of operation or a pulsating mode of operation. The change in operating mode is caused by a change in |V|. The change of |V| that is required may be determined by reference to a previously-determined signal versus |V| or current versus |V| map of the type depicted in FIGS. 6A-6B. If the emitter is ordinarily in close proximity to an ion inlet of a mass spectrometer during normal operation, then it may be necessary to execute a preliminary step 301, prior to the execution of step 302, in order to prevent ingestion of contaminants into the inlet. In the step 301, the application of voltage may be discontinued and the emitter may be moved to a new position, from which contamination of the inlet does not occur. Alternatively, it may be possible, in some instances, to protect the mass spectrometer inlet while maintaining the emitter in proximity to the inlet by initiating a flow of a protective sweep gas past the emitter and inlet, thereby pushing any potential contaminants away from the inlet.

In step 304 of the method 300, a cleaning solvent is caused to flow through the electrospray emitter, while the emitter is operated in dripping mode or pulsating mode. The flow of cleaning solvent through the so-operated emitter continues at least until a droplet of the cleaning solvent forms on the emitter exterior. In step 306, the droplet is caused to dislodge from the emitter exterior, thereby removing any solid residue that dissolved into the droplet during the time that the droplet was suspended on the emitter.

Because it is generally unlikely that a single droplet will dissolve all residue, the steps 304 and 306 may need to be repeated one or more times, with the emitter continuously operating in dripping are pulsating mode during the repetitions.

The dislodging of the droplet of cleaning solvent in step 306 may occur under the action of gravity. In such instances, the step 306 consists simply of waiting for the droplet to fall from the emitter surface. Alternatively, the dislodging of the droplet in step 306 may be caused or at least assisted by directing a pulse of gas towards the droplet. The pulse of gas may be supplied by a nebulizing gas orifice of the electrospray emitter, if present. Alternatively, if the first electrospray emitter does not comprise a nebulizing gas orifice, the gas pulse may be provided by an auxiliary gas line provided for the purpose of supplying the gas pulse. As a further alternative, the droplet may be dislodged by providing a voltage pulse to either the first electrospray emitter or the associated counter-electrode. Such a voltage pulse may cause a temporary discharge of liquid from an internal channel of the first electrospray emitter that physically dislodges the droplet of cleaning solvent. As a yet further alternative, voltage pulses may be applied simultaneously with the application of gas pulses.

Figure 7B:
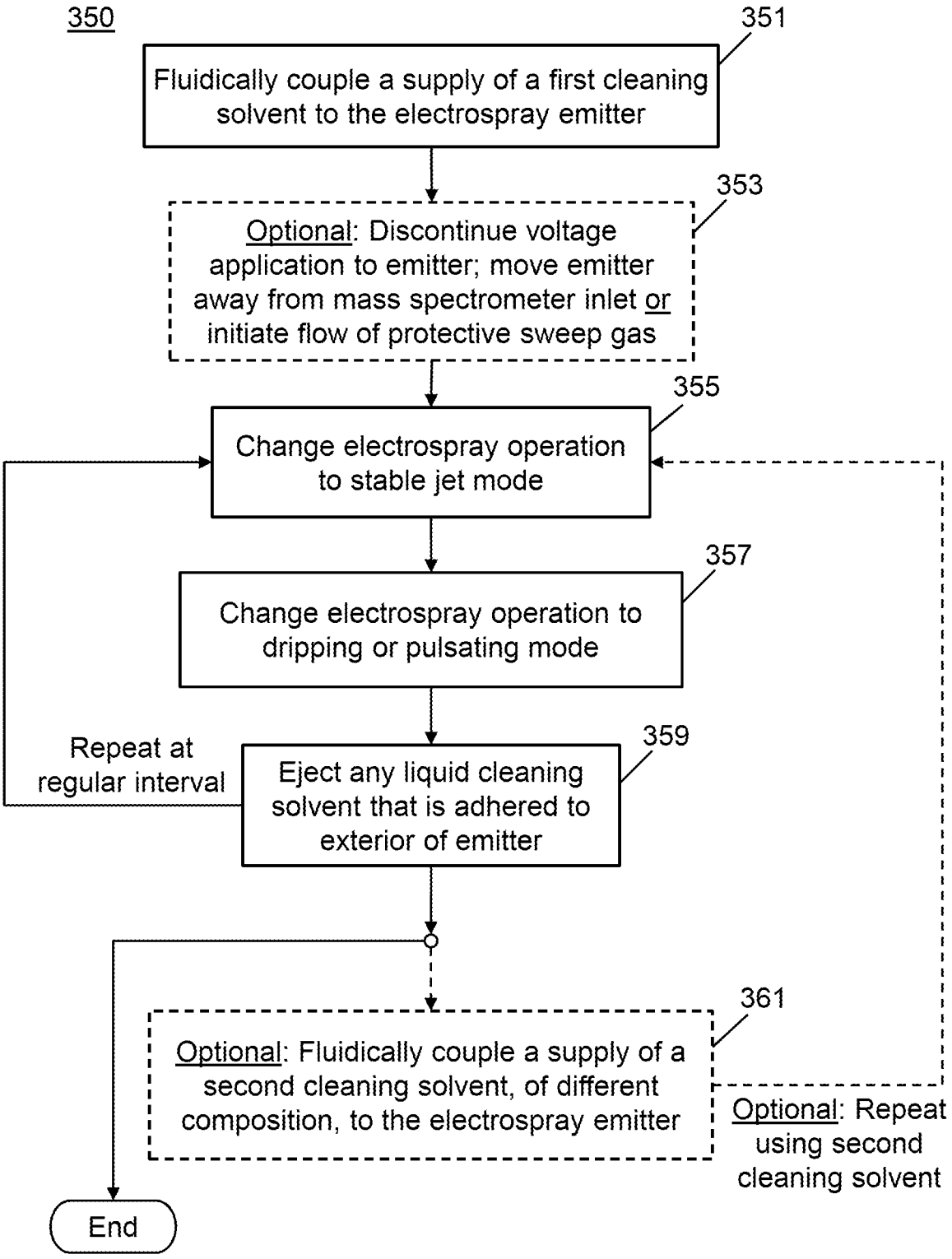
FIG. 7B is a flow diagram of a second method for cleaning an electrospray emitter in accordance with the present teachings.

FIG. 7B is a flow chart of a second method for cleaning an electrospray emitter in accordance with the present teachings. In step 351, an inlet of the electrospray emitter is fluidically coupled to a source of a first cleaning solvent. Although the cleaning solvent may be under pressure, the solvent may not necessarily flow through the emitter if a voltage, V, is not applied between a counter electrode and the emitter. Step 353 is an optional step that may be undertaken in order to prevent ingestion of contaminants into an ion inlet of a mass spectrometer. In step 353, the application of voltage may be discontinued and the emitter may be moved to a new position, from which contamination of the inlet does not occur. Alternatively, it may be possible, in some instances, to protect the mass spectrometer inlet while maintaining the emitter in proximity to the inlet by initiating a flow of a protective sweep past the emitter and inlet, thereby pushing any potential contaminants away from the inlet.

The next three steps, comprising steps 355, 357 and 359 are then repeated a plurality of times, the repetitions preferably occurring with an approximately constant frequency. For example, the repetition frequency may be in the range of 0.01-100 Hz. The optimal frequency for any experimental configuration will depend on the liquid flow rate, the emitter internal diameter, and the liquid properties (e.g., viscosity, density, etc.) which may be functions of liquid composition and temperature.

In step 355, the magnitude of the voltage applied between the counter electrode and the emitter, |V|, is adjusted so as to establish a stable jet mode of operation. The change in |V| that is necessary for such operation may be determined by reference to a previously-determined signal versus |V| or current versus |V| map of the type depicted in FIGS. 6A-6B. Subsequently, |V| is again adjusted, in step 357, so that the mode of operation of the emitter changes to either a dripping or a pulsating mode of operation. Once again, the necessary change in |V| may be determined by reference to data of the type depicted in FIGS. 6A-6B. In step 359, any droplets or film of the cleaning solvent that may have adhered to the emitter during operation in the dripping or pulsating mode are forcibly ejected. The ejection may be caused by directing a pulse of gas towards the emitter tip. The pulse of gas may be supplied by a nebulizing gas orifice of the electrospray emitter. Alternatively, if the electrospray emitter does not comprise a nebulizing gas orifice, the gas pulse may be provided by an auxiliary gas line provided for the purpose of supplying the gas pulse. As a further alternative, the droplet may be dislodged by providing a voltage pulse to either the electrospray emitter or its associated counter-electrode. As a yet further alternative, gas pulses and voltage pulses may be applied at the same frequency, either simultaneously or with different phases. The ejection of droplets or films of the cleaning solvent also removes molecules of any unwanted surface contaminants that may have been dissolved into or suspended into the cleaning solvent, thereby progressively cleaning the emitter.

Figure 4A:
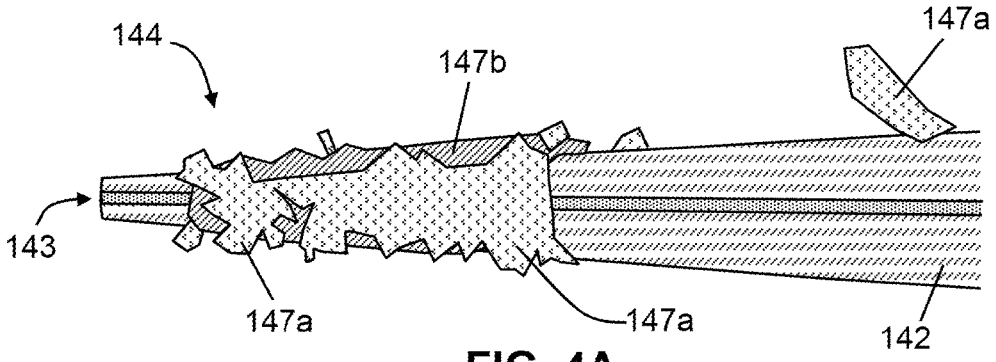
FIG. 4A is a to-scale schematic depiction of a fouled nano-electrospray emitter tip, as reproduced from a 200× photomicrograph, subsequent to approximately 1000 sample injections.
Figure 4B:
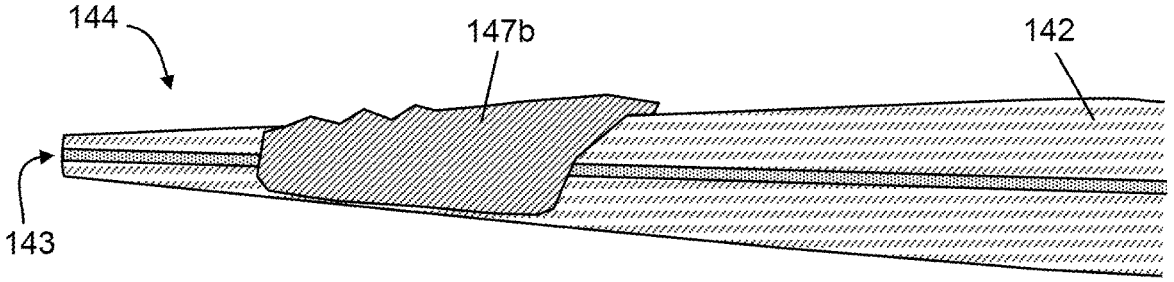
FIG. 4B is a to-scale schematic depiction of the nano-electrospray emitter tip of FIG. 4A, as reproduced from a 200× photomicrograph, subsequent to cleaning with acidified water.
Figure 5:
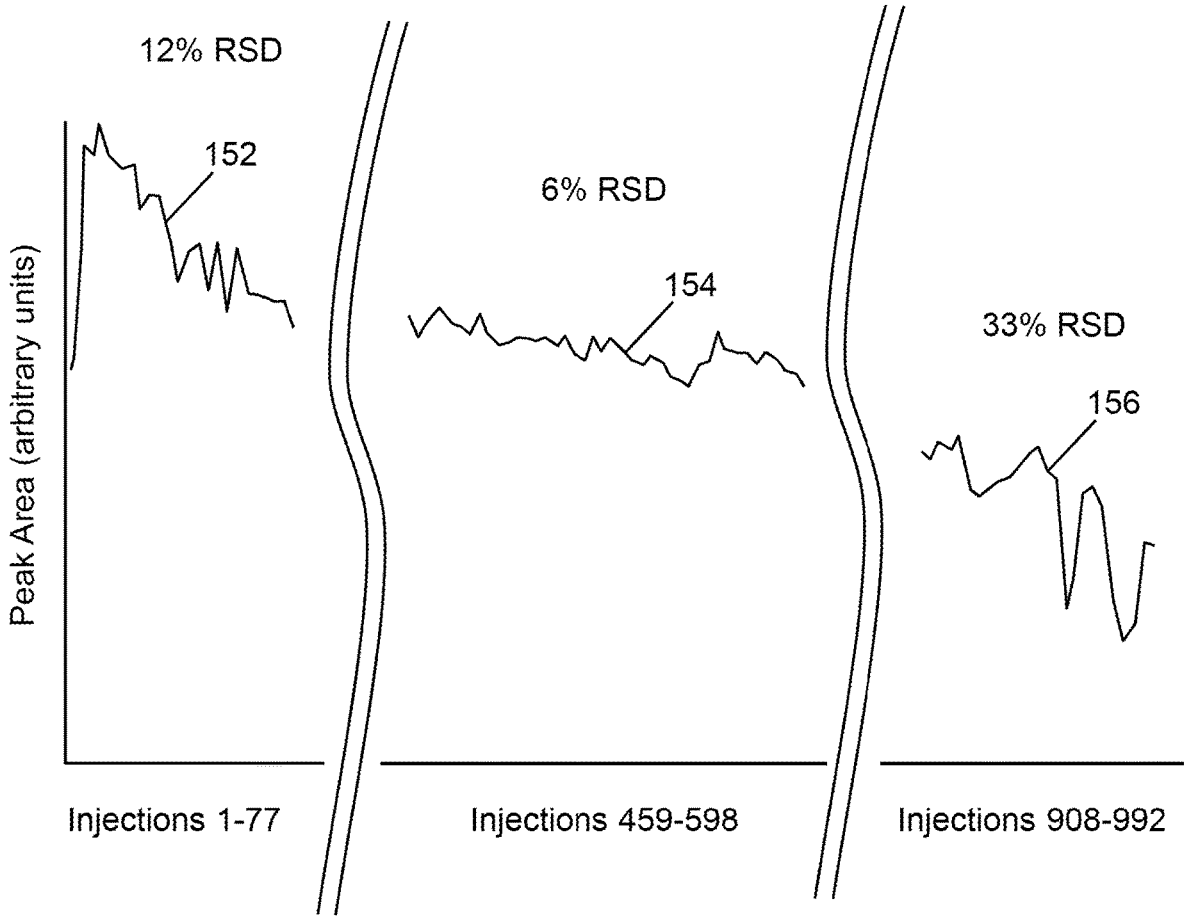
FIG. 5 is a plot of the measured peak area of a single peptide as observed during a series of sample injections into the fouled emitter of FIGS. 4A-4B at each of three periods of its service lifetime.

The execution of the method 350 may terminate after a certain predetermined number of repetitions of the steps 355, 357 and 359 or after a certain predetermined time duration. Alternatively, an inlet of the electrospray emitter is fluidically coupled to a source of a second cleaning solvent, having a composition that is different than that of the first cleaning solvent, in step 361. The iterative process of steps 355, 357 and 359 may then be repeated with the second cleaning solvent being caused to flow through the emitter. Cleaning with a second solvent may be necessary if more than one contaminant compound is adhered to the emitter, as indicated in FIGS. 4A-4B, since the different compounds may have different solubility characteristics.

One or more cleaning solvents are supplied to electrospray emitters during execution of the cleaning methods described herein. In some instances, the cleaning solvent may be identical to a mobile phase solvent that is employed during chromatographic fractionation of samples. In such instances, if an emitter that is being cleaned is fluidically coupled to a chromatographic column, then the mobile phase solvent (being used as a cleaning solvent) may be supplied to the emitter through the coupled column. In other instances, the cleaning solvent may comprise a composition that reacts with column components in a way that either damages the column or is detrimental to the continued operation of the column. In such latter instances, the emitter should be fluidically isolated from the associated column during the cleaning. This isolation may be achieved by physically de-coupling and removing the column or its fixture from a union that otherwise joins the column and the emitter.

Figure 8:
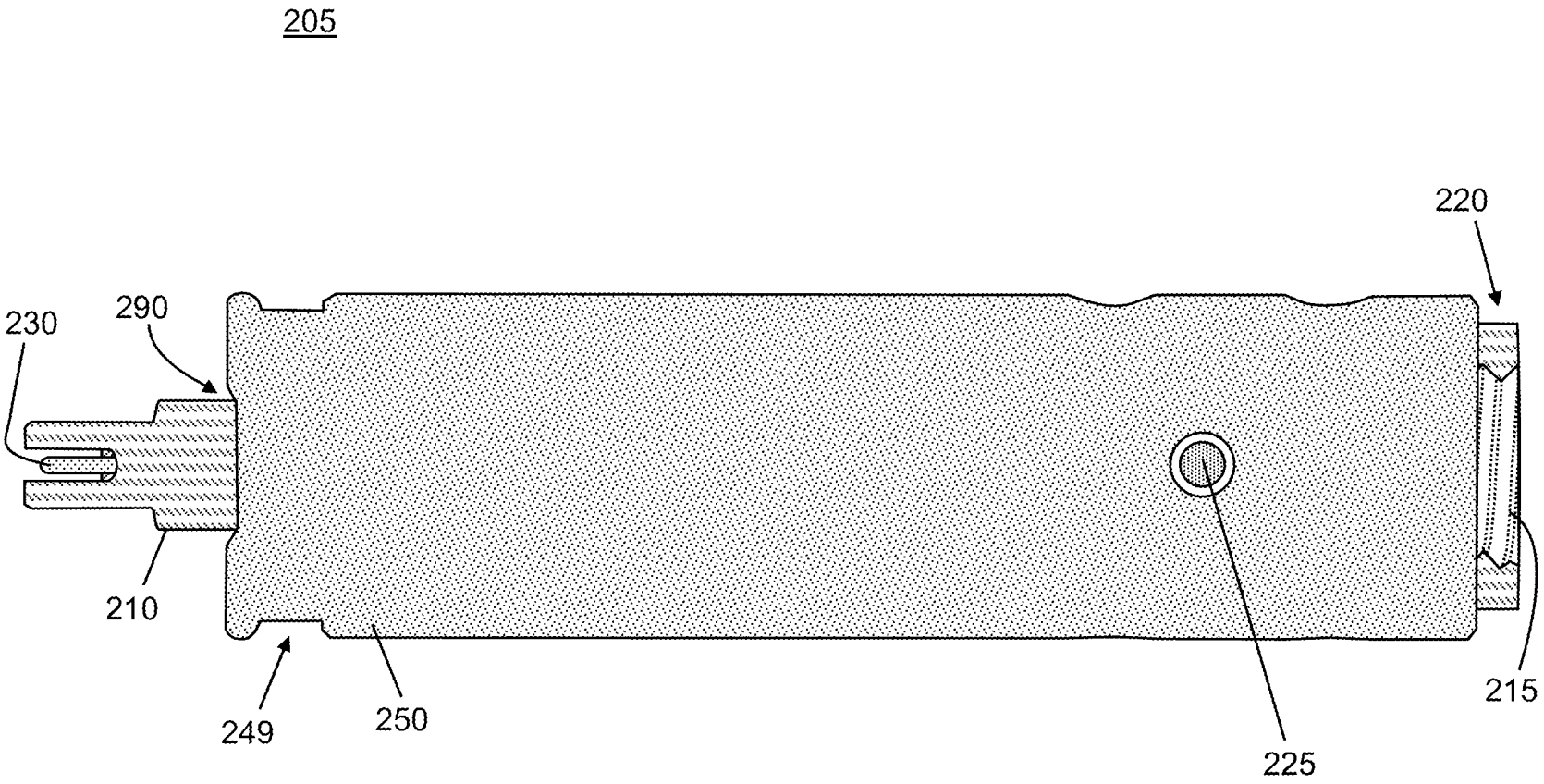
FIG. 8 is a schematic representation of a portion of the exterior of the cartridge of FIG. 2B, as modified by inclusion of an auxiliary fluid inlet port.

Unfortunately, physical removal of a column may be difficult or inconvenient if both the column and emitter are embedded within a common cartridge. To facilitate the cleaning procedure with a solvent that is incompatible with the embedded column, the cartridge may be provided with an auxiliary fluid inlet port, in accordance with certain implementations of the present teachings. Alternatively or in addition, it may be desirable to main some flow of solvent or mobile phase through the column to prevent backflow from the auxiliary port into the column. FIG. 8 is a schematic representation of a portion of the exterior of the cartridge of FIG. 2B, as modified by inclusion of an auxiliary fluid inlet port 225. The auxiliary fluid inlet port 225 and the length and/or positioning of the union 220 are configured to deliver the cleaning solvent into a gap between an outlet end of the column and an inlet end of the emitter, thereby causing the flow of cleaning solvent to bypass the column. Additionally, a check valve may be incorporated within the cartridge between the column outlet and the auxiliary fluid inlet port 225 to prevent backflow of the cleaning solvent into the column. Introducing cleaning solvents through the auxiliary fluid inlet port 225 allows use of more aggressive chemicals to clean the emitter while bypassing the fluidics required for separation.

Figure 9A:
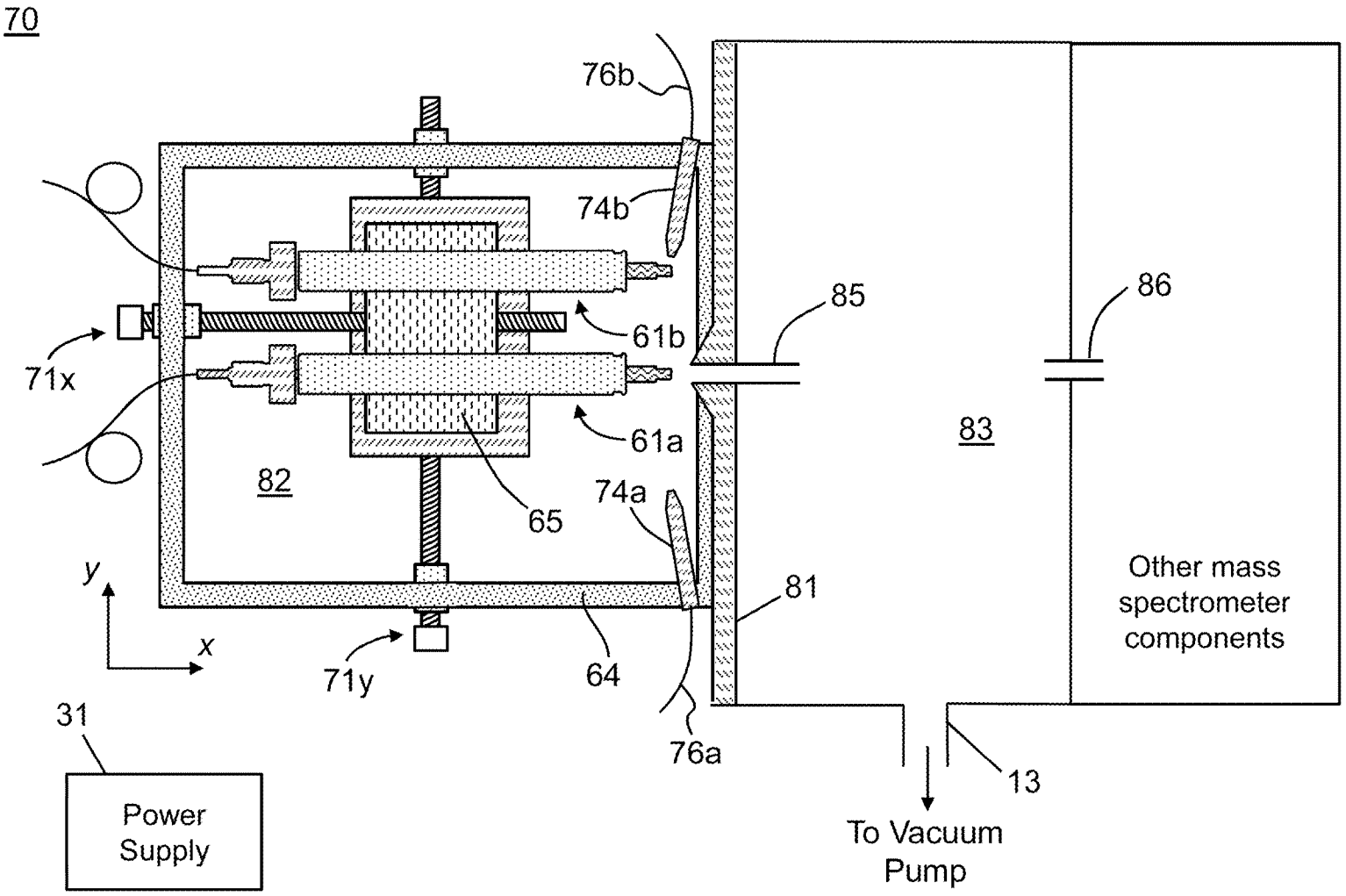
FIG. 9A is a schematic depiction of an electrospray ion source for a mass spectrometer in accordance with the present teachings, the ion source comprising two electrospray emitters housed in respective cartridges that are mounted on a moveable stage or platform, the depiction showing a first electrospray emitter in operating position at the same time that a second electrospray emitter is in a cleaning position.
Figure 9B:
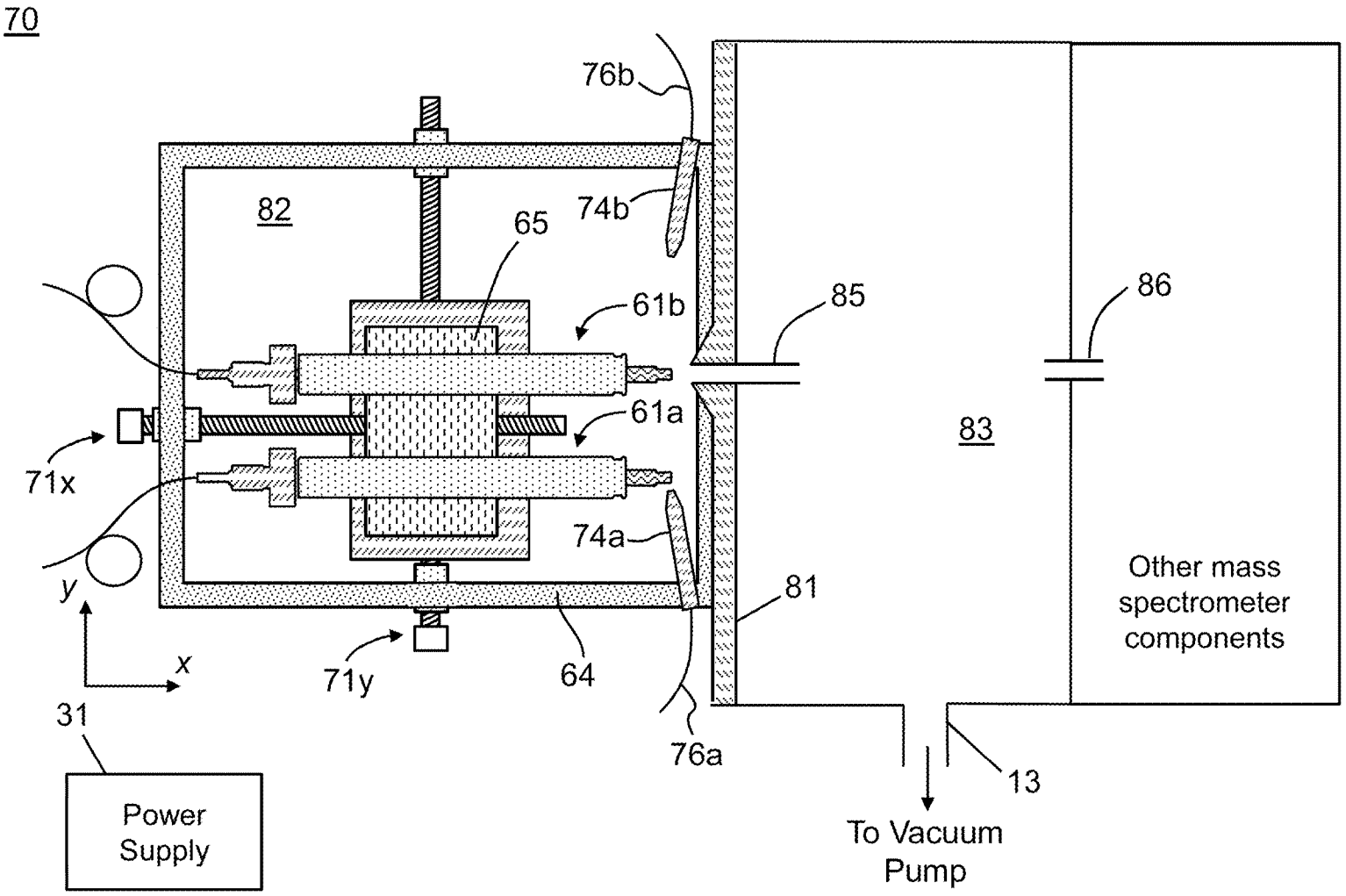
FIG. 9B is another depiction of the electrospray ion source of FIG. 9A, showing the second electrospray emitter in operating position at the same time that the first electrospray emitter is in cleaning position.

FIGS. 9A-9B are schematic depictions of an electrospray ion source 70 for a mass spectrometer that comprises two electrospray emitters that are housed in respective cartridges 61*a*, 61*b*. FIG. 9A depicts a first configuration in which a first emitter 61*a* in normal operating position adjacent to mass spectrometer ion inlet 85 at the same time that a second emitter 61*b* is in its respective cleaning position. FIG. 9B depicts a second configuration in which the second emitter 61*b* is in the normal operating position while, at the same time, the first emitter 61*a* is in its respective cleaning position. In the ion source 70, a mounting assembly 64, which is preferably removable from a mass spectrometer comprises an ionization chamber 82 therein. At least a portion of each of the cartridges 61*a*, 61*b* is disposed within the ionization chamber. Both cartridges are mounted on at least one stage or platform 65 that is moveable on or within the mounting assembly and that may be a component of the mounting assembly. The at least one stage or platform 65 is moveable parallel to at least two axes which are, preferably orthogonal to one another. In FIGS. 9A-9B, the movement is assumed to be parallel to either one of orthogonal x and y axes. The movement of the platform or stage is such that a first electrospray emitter cartridge 61*a* may be in service under normal operation at an operating position adjacent to ion inlet 85 while a second, spare electrospray emitter cartridge 61*b* is available at its respective cleaning position, as shown in FIG. 9A. While at the second cleaning position, the emitter of the spare cartridge 61*b* may be in the process of being cleaned or, if already clean, may be available to be placed into operational service by movement into the operating position. Movement of the stage or platform 65 in the negative y-direction (see axes designations on FIG. 9A) moves the spare emitter cartridge 61*b* into the operating position while, at the same time, moving the first emitter cartridge 61*a* to its respective cleaning position. After the move, the spare electrospray emitter 61*b* may be placed into normal operational service while the first emitter 61*a* is being cleaned. One or more power supplies 31 are electrically coupled to the emitters in order to apply a voltage between each emitter and a counter electrode that is either at, near to or identical the ion inlet 85. By this means, ions may be generated, alternately, by each one of the two emitters, thereby enhancing instrument sample throughput.

The procedure for cleaning the emitters of the emitter cartridges 61*a*, 61*b* is as described supra. As previously noted herein, a cleaning procedure may comprise directing a pulse of gas at or towards a pendant droplet of cleaning solvent. If an emitter assembly within a cartridge comprises a nebulizing gas channel, such as the channels 118 shown in FIG. 1B, then the gas pulse may be provided through that channel. If, however, the emitter assembly does not include a gas channel, then the gas pulse must be provided an external gas nozzle, such as the gas nozzles 74*a*, 74*b* illustrated in FIGS. 9A-9B. As illustrated, each of the gas nozzles 74*a*, 74*b* may be mounted in a fixed position relative to the cleaning position of the emitter to which it directs a gas pulse when that emitter is in its cleaning position. Gas supply lines 76*a*, 76*b* provide gas flow to the nozzles 74*a* and 74*b*, respectively.

Figure 9C:
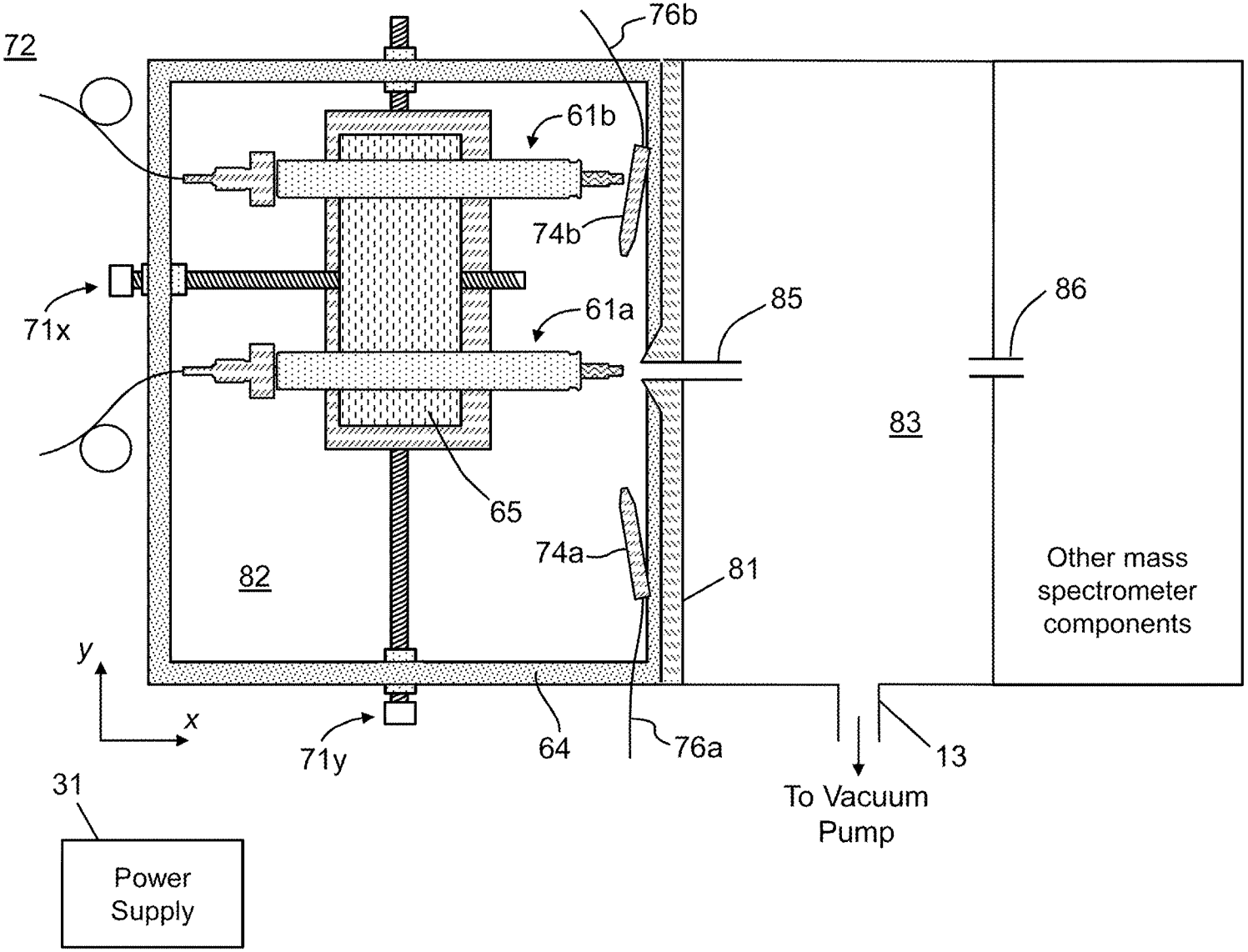
FIG. 9C is a schematic depiction of another electrospray ion source for a mass spectrometer in accordance with the present teachings, the ion source comprising two electrospray emitters housed in respective cartridges that are mounted on a moveable stage or platform, the depiction showing a first electrospray emitter in operating position at the same time that a second electrospray emitter is in a ready-to-use position.
Figure 9D:
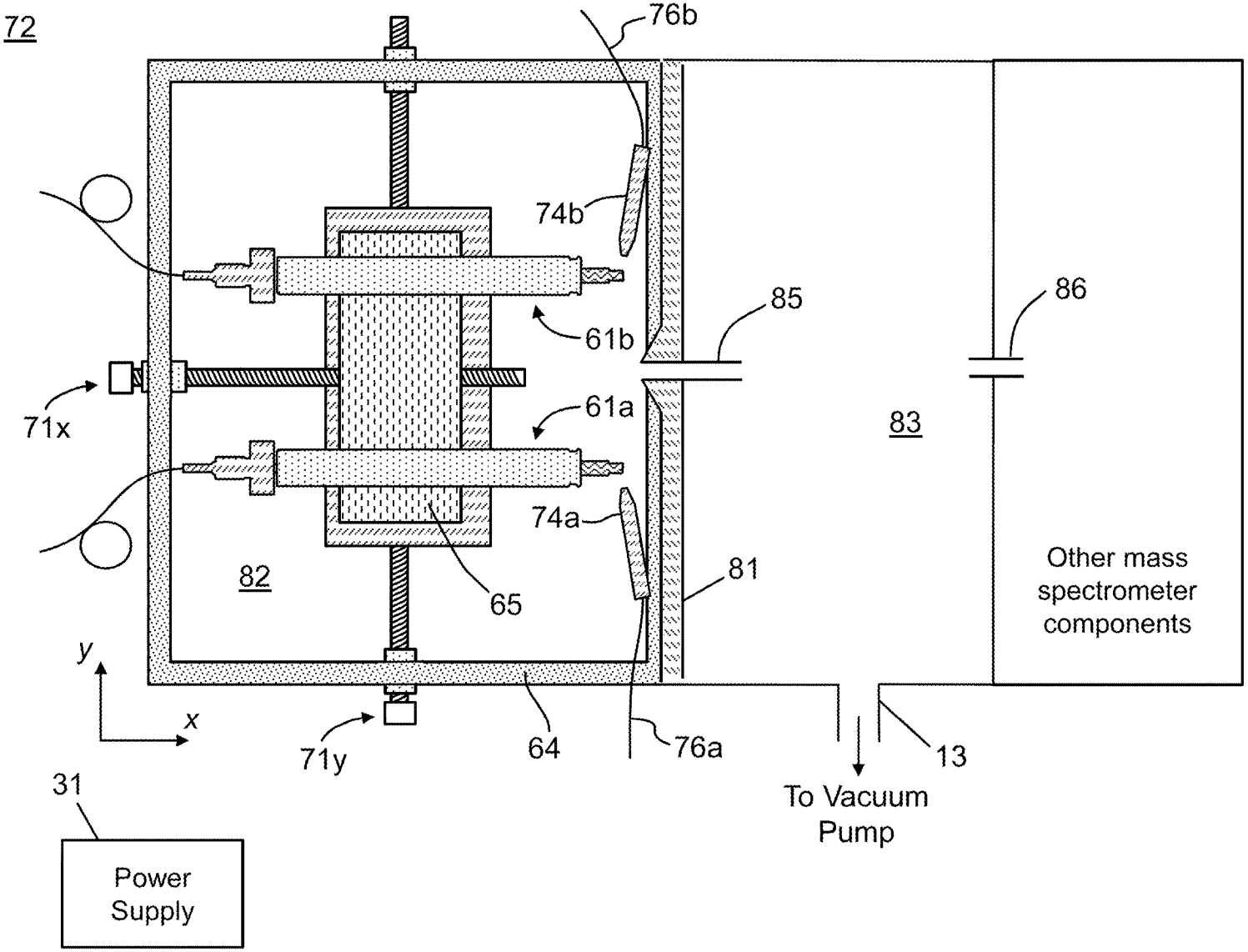
FIG. 9D is another depiction of the electrospray ion source of FIG. 9C, showing the first and second electrospray emitters simultaneously in respective cleaning positions.

FIGS. 9C-9D are schematic depictions of another electrospray ion source 72 that comprises two electrospray emitter cartridges disposed a moveable stage or platform. Like the above-described electrospray ion source 70 (FIGS. 9A-9B), the moveable stage/platform 65 of the electrospray ion source 72 comprises a first position (FIG. 9C) in which the first cartridge 61*a* is in a normal operating position and a second position (not illustrated) in which the second cartridge 61*b* is in the normal operating position. In addition, the stage/platform of the electrospray ion source 72 comprises at least a third position (FIG. 9D) in which neither cartridge is in the operating position and in which, instead, both cartridges are disposed at their respective cleaning positions.

Mechanisms for effecting the movement of the stage or platform 65 (FIGS. 9A-9D) along the x, y axes are schematically illustrated by screw mechanisms 71*x* and 71*y*, respectively. Slidable engagement between the stage or platform 65 and fixed portions of the mounting assembly 64 or between separate components of the stage or platform may be facilitated by one or more of several known structures, such as rails, rods, sliding dovetails, etc. The illustration in FIG. 9 is schematic only. So-called x-y and x-y-z translational stages and one of ordinary skill in the mechanical arts would readily understand how to adapt such stages or design components thereof, to the task of creating a moveable platform for two electrospray emitters or cartridges.

Figure 10:
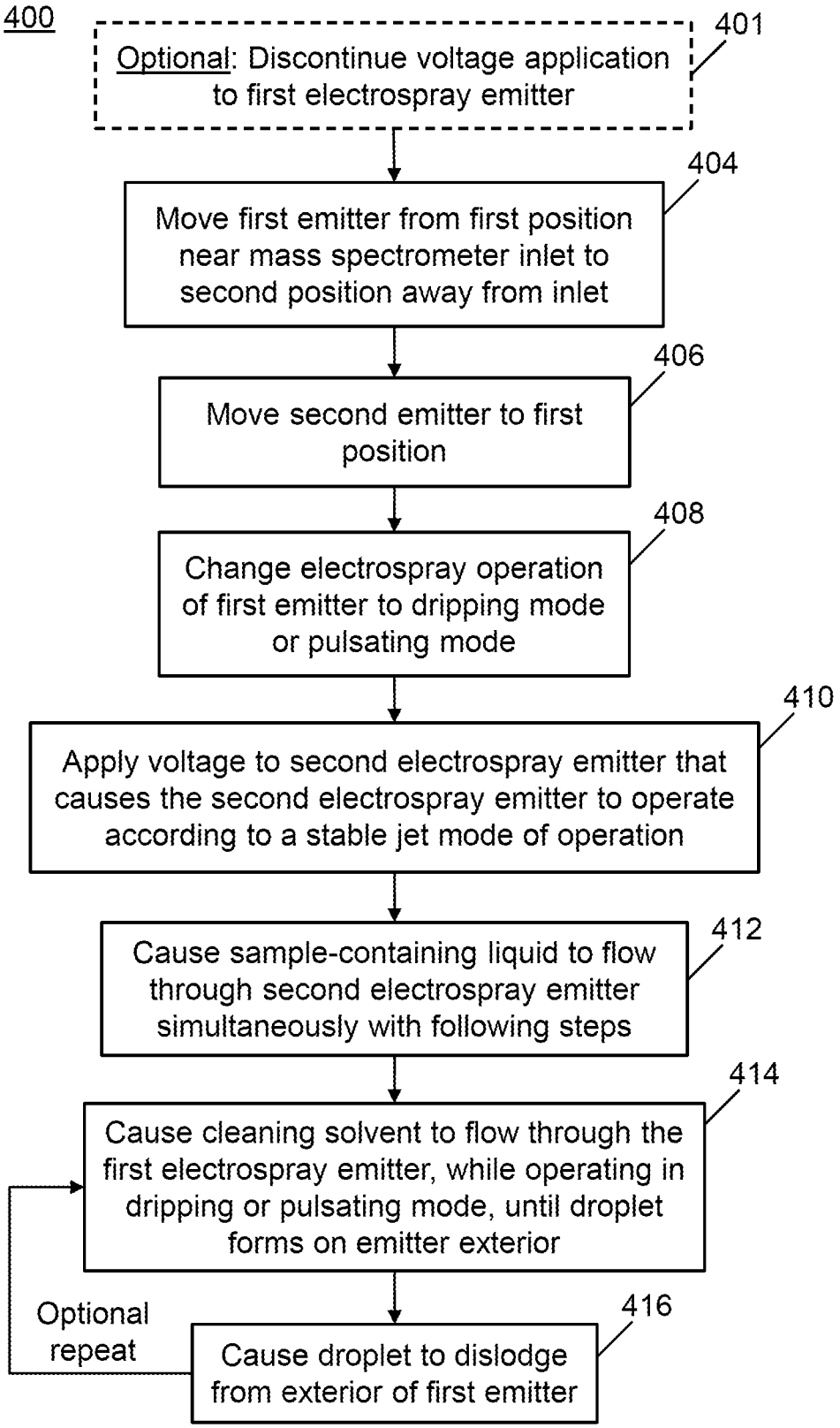
FIG. 10 is a flow diagram of a third method for cleaning an electrospray emitter in accordance with the present teachings.

FIG. 10 is a flow diagram of a third method for cleaning an electrospray emitter in accordance with the present teachings. The method 400 depicted in FIG. 10 pertains to the cleaning of a first emitter of a pair of moveable emitter cartridges configured, as illustrated in FIGS. 9A-9B, within a mounting assembly that is attached to a mass spectrometer. In optional step 401, the application of a voltage between a counter electrode and the first emitter may be discontinued in order to prevent ingestion of contaminants into the inlet during movement of the two emitters. In step 402, the first emitter (e.g., the emitter housed within cartridge 61*a* in FIGS. 9A-9B) is moved from a first position (i.e., its normal operating position adjacent to mass spectrometer inlet 85 in FIG. 9A) to a cleaning position (e.g., as in FIG. 9B).

In step 406 of the method 400 (FIG. 10), the second emitter (e.g., the emitter housed within cartridge 61*b* in FIG. 9) is moved to the first position, that was originally occupied by the first emitter. If the movement of both the first and second emitters is effected by the movement of a moveable stage or platform (e.g., stage or platform 65), then steps 404 and 406 occur simultaneously. A first movement of the stage or platform 65 in the negative x-direction (see axes on FIGS. 9A-9B) disengages the first emitter from the ion inlet 85 and also moves the second emitter by the same amount in the same direction. A second movement in the negative y-direction moves the axis of the first emitter out of alignment with the axis of the ion inlet and moves the axis of the second emitter into alignment with the inlet axis. A final movement of the stage or platform in the positive x-direction brings the second emitter into engagement with the ion inlet and brings the first emitter into its cleaning position. If the first emitter comprises a protective sleeve (e.g., protective sleeve 240 in FIG. 2B), then a cleaning fixture (not illustrated) may be provided as part of the mounting assembly 64 such that engagement with the cleaning fixture retracts the protective sleeve and exposes the emitter tip. The tip of the second emitter is exposed by its engagement with the ion inlet.

Returning to the discussion of FIG. 10, once the first emitter is in its cleaning position, a first voltage, $V_1$, is applied between the counter electrode and the first electrospray emitter, in step 408, that causes it to operate in a dripping mode or pulsating mode. At about the same time, a second voltage, $V_2$, is applied between the counter electrode and the second electrospray emitter, in step 410, that causes the second electrospray emitter to operate according to a stable jet mode of operation. The magnitude of the voltage, $|V_1|$ or $|V_2|$, that is required in each case may be determined by reference to a previously-determined signal versus |V| or current versus |V| map of the type depicted in FIGS. 6A-6B. A different such map may be required for each emitter. In step 412, a sample-containing liquid is caused to flow through the second emitter, thereby putting that emitter into operational service supplying ions for the mass spectrometer to manipulate and analyze. At about the same time, a cleaning solvent is caused to flow through the first electrospray emitter, in step 414, while that emitter is operating in dripping mode or pulsating mode. Steps 412 and 414 may include a re-routing of the flow of sample-containing liquid from the first emitter to the second emitter and, possibly, a re-routing of cleaning solvent from the second emitter to the first emitter by reconfiguration of one or more fluidic switching valves (not illustrated).

With the first emitter being operated in either dripping mode or pulsating mode, one or more droplets or films of liquid will adhere to the emitter exterior. Such droplets are caused to dislodge from the emitter in step 416. The dislodging may occur under the action of gravity. Alternatively, the dislodging of the droplet may be caused or assisted by directing a pulse of gas towards the droplet. The pulse of gas may be supplied by a nebulizing gas orifice of the electrospray emitter or, if the electrospray emitter does not comprise a nebulizing gas orifice, by an auxiliary gas line that is directed towards the position of the first emitter in its cleaning position. As a yet further alternative, the droplet may be dislodged by providing a voltage pulse to either the electrospray emitter or its associated counter electrode or by providing both a gas pulse and a voltage pulse, either simultaneously or in sequence. The steps 414 and 416 may be repeated one or more times in order to thoroughly clean the first emitter of all contaminants. In alternative embodiments, the steps 414 and 416 may be replaced by steps similar to the steps 355, 357 and 359 of method 350 (FIG. 7B) in which, during cleaning, the mode of operation of the first emitter is repeatedly switched between stable jet operation and dripping or pulsating operation.

The emitter cleaning methods taught herein may be initiated by a decision of an instrument operator or user such as, for example, when visual inspection of the emitter or of the spray jet suggests a buildup of contaminant materials. Alternatively, these cleaning methods may be initiated executed automatically, upon an automatic check for spray stability. The check for spray stability may automatically check the signal-to-noise ratio of mass spectra of one or more standard samples relative to a first threshold value or may automatically check the relative standard deviations of peak areas of such standard samples relative to a second threshold value. The cleaning methods described herein are ideally performed when an associated chromatographic system is performing ancillary tasks, such as during a wash step of a chromatography gradient program or during a blank injection.

Methods and apparatus for improving electrospray emitter lifetimes have been herein disclosed. The discussion included in this application is intended to serve as a basic description. The present invention is not intended to be limited in scope by the specific embodiments described herein, which are intended as single illustrations of individual aspects of the invention. Instead, the invention is limited only by the claims. Various other modifications of the invention, in addition to those shown and described herein will become apparent to those skilled in the art from the foregoing description and accompanying drawings. All such variations and functionally equivalent methods and components are considered to be within the scope of the invention. Any patents, patent applications, patent application publications or other literature mentioned herein are hereby incorporated by reference herein in their respective entirety as if fully set forth herein, except that, in the event of any conflict between the incorporated reference and the present specification, the language of the present specification will control.

What is claimed is:

1. A method for cleaning a first electrospray emitter of a mass spectrometer, comprising:

(a) changing a mode of operation of the first electrospray emitter from a stable jet mode of operation to a dripping mode or a pulsating mode of operation by lowering a magnitude of a voltage applied between a counter electrode and the first electrospray emitter, $|V_1|$;

(b) moving the first electrospray emitter from a first emitter position from which electrospray ions are delivered to an inlet of a mass spectrometer to a second emitter position and, simultaneously, moving a second electrospray emitter from a third emitter position to a fourth emitter position;

(c) causing a cleaning solvent to flow through the first electrospray emitter at least until a droplet of the cleaning solvent forms on an exterior surface of the first electrospray emitter while operating the electrospray emitter in the dripping mode of operation; and (d) causing the droplet to dislodge from the electrospray emitter exterior.

2. A method for cleaning a first electrospray emitter of a mass spectrometer as recited in claim 1, further comprising:

(e) moving the second electrospray emitter from the fourth emitter position to the first emitter position;

(f) applying a voltage, $V_2$, between the counter electrode and the second electrospray emitter that has a magnitude, $|V_2|$, that causes the second electrospray emitter to operate according to a stable jet mode of operation;

(g) causing a sample-containing liquid to flow through the second electrospray emitter.

3. A method as recited in claim 1, wherein the first electrospray emitter and the second electrospray emitter are housed within a same cartridge.

4. A method as recited in claim 3, wherein the first electrospray emitter is fluidically coupled to a first chromatographic column and the second electrospray emitter is fluidically coupled to a second chromatographic column and the first and second chromatographic columns are both housed within the same cartridge that houses the first and second electrospray emitters.

5. A method for cleaning an electrospray emitter of a mass spectrometer as recited in claim 1, wherein the steps (a) through (d) are performed automatically upon the occurrence of a pre-determined number of injections of a sample or samples into the first electrospray emitter subsequent to a prior cleaning of the first electrospray emitter.

6. A sample introduction system for a mass spectrometer comprising:

(i) one or more sample sources;

(ii) at least one chromatographic column, each said chromatographic column comprising a column outlet and a column inlet that is fluidically coupled to at least one of the one or more sample sources;

(iii) first and second electrospray emitters, each electrospray emitter comprising an emitter inlet that is fluidically coupled to at least one column outlet;

(iv) a source of cleaning solvent that is fluidically coupled to each emitter inlet;

(v) a voltage supply electrically coupled to the first and second electrospray emitters and to a counter electrode; and (vi) a computer or electronic controller comprising computer-readable instructions that are operable to:

(a) cause the voltage supply to lower a magnitude of a voltage applied between the counter electrode and the first electrospray emitter, |V|, wherein the lowering of |V| causes a change of a mode of operation of the electrospray emitter from a stable jet mode of operation to a dripping mode or a pulsating mode of operation;

(b) cause the first electrospray emitter to move from a first emitter position from which electrospray ions are delivered to an inlet of a mass spectrometer to a second emitter position and, simultaneously, cause the second electrospray emitter to move from a third emitter position to a fourth emitter position;

(c) cause at least a portion of the cleaning solvent to flow from the source of cleaning solvent to and through the first electrospray emitter at least until a droplet of the cleaning solvent forms on an exterior surface of the electrospray emitter while operating the electrospray emitter in the dripping mode of operation; and (d) cause the droplet to dislodge from the electrospray emitter exterior.

7. A sample introduction system for a mass spectrometer as recited in claim 6, further comprising:

(vii) a source of gas, wherein the computer-readable instructions that are operable to cause the droplet to dislodge from the electrospray emitter exterior are operable to cause the dislodgement by causing the source of gas to apply a pulse of gas to the droplet.

8. A sample introduction system for a mass spectrometer as recited in claim 6, wherein the at least one chromatographic column and the first and second electrospray emitters are housed within a same cartridge.

9. A sample introduction system for a mass spectrometer as recited in claim 6, wherein the computer-readable instructions are further operable to automatically execute the steps (a) through (c) upon the occurrence of a pre-determined number of injections of a sample or samples into the first electrospray emitter subsequent to a prior cleaning of the first electrospray emitter.

10. A sample introduction system for a mass spectrometer as recited in claim 6, wherein the computer-readable instructions are further operable to:

cause the second electrospray emitter to move from the fourth emitter position to the first emitter position;

cause the voltage supply to apply a voltage, $V_2$, between the counter electrode and the second electrospray emitter that has a magnitude, $|V_2|$, that causes the second electrospray emitter to operate according to a stable jet mode of operation; and cause a sample-containing liquid to flow through the second electrospray emitter.

11. A sample introduction system for a mass spectrometer as recited in claim 6, wherein the computer-readable instructions are further operable to:

(d) cause a cessation of the flow of cleaning solvent to and through the first electrospray emitter;

(e) cause the first electrospray emitter to move from the second emitter position to the first emitter position;

(f) cause a flow of liquid sample to flow from the at least one column outlet to the inlet of the first electrospray emitter; and (g) increase the applied value of |V|, wherein the increase of |V| causes a change of a mode of operation of the first electrospray emitter from the dripping mode of operation to the stable jet mode of operation.

* * * * *